US008024844B2

(12) United States Patent
Aoto

(10) Patent No.: US 8,024,844 B2
(45) Date of Patent: Sep. 27, 2011

(54) CLIP

(76) Inventor: Masaaki Aoto, Osaka (JP)

( * ) Notice: Subject to any disclaimer, the term of this patent is extended or adjusted under 35 U.S.C. 154(b) by 909 days.

(21) Appl. No.: 11/997,739

(22) PCT Filed: Jun. 7, 2006

(86) PCT No.: PCT/JP2006/311389

§ 371 (c)(1),
(2), (4) Date: Feb. 1, 2008

(87) PCT Pub. No.: WO2007/015338

PCT Pub. Date: Feb. 8, 2007

(65) Prior Publication Data

US 2010/0154175 A1 Jun. 24, 2010

(30) Foreign Application Priority Data

Aug. 1, 2005 (JP) ..... 2005-222417

(51) Int. Cl.
*B42F 1/02* (2006.01)
*B42F 1/04* (2006.01)
*B42F 1/08* (2006.01)

(52) U.S. Cl. ..... 24/67.9; 24/DIG. 10; D19/86

(58) Field of Classification Search ..... 24/69.7, 24/DIG. 10; D19/86
See application file for complete search history.

(56) References Cited

U.S. PATENT DOCUMENTS 1,780,893 A * 11/1930 Schmitt ..... 24/546
2,116,238 A * 5/1938 Harvey ..... 24/555
2,323,552 A * 7/1943 Marion et al. ..... 24/546
2,781,566 A * 2/1957 Hammer ..... 24/67.9
4,024,608 A * 5/1977 Brewer ..... 24/547

* cited by examiner

*Primary Examiner* — Robert Sandy
(74) *Attorney, Agent, or Firm* — Ogilvie Law Firm

(57) ABSTRACT

A clip is easily usable even by a visually handicapped person and a presbyope. The clip has bend sections, rectilinear sections, and a connection section. The bend sections can be located at positions close to each other with a spacing equal to or less than the diameter of the wire material of the clip held between them. The rectilinear sections are bent upward and some are in contact with each other.

5 Claims, 14 Drawing Sheets

CLIP

TECHNICAL FIELD

The invention generally relates to a clip and in particular relates to a clip having resiliency and formed of a wire material, which is used to clip sheets of documents and cloth.

BACKGROUND ART

Conventionally, this type of clip is called a GEM clip, and the shape thereof is described in, for example, Japanese Published Unexamined Patent Application No. H-4-67082 (Patent Document 1).

FIG. 2, FIG. 4 FIG. 6 and FIG. 8 are plan views (A) and front elevational views (B) of a prior art profile of a clip.

As shown in these drawings, by bending a single wire or a single wire material, prior art clip 200, 400, 600 or 800 inwardly has first bend section 210, 410, 610 or 810 formed as a relatively smaller loop-shaped annular section at one side in the longitudinal direction thereof and has second bend section 220, 420, 620, or 820 formed as a relatively larger loop-shaped annular section, while outwardly having a loop-shaped connection sections 270, 470, 670 or 870 at the other side in the longitudinal direction thereof. The prior art clip 200, 400, 600 or 800 has a flat shape as the entirety, and as shown in the respective drawings (B), the respective bend sections and connection sections are molded so as to be positioned almost at the same plane.

With a prior art clip having such a shape, the clip is used to fix a plurality of sheets in such a manner that a relatively large second bend section 220, 420, 620 or 820 is pressed to the surface of documents while a relatively small first bend section 210, 410, 610 or 810 is pressed and widened by fingertips, and after sheets are placed between the first bend section 210, 410, 610 or 810 and the second bend section 220, 420, 620 or 820 and the clip is moved along the surface of the sheets, the connection section 270, 470, 670 or 870 is fastened with the side of a plurality of sheets.

DISCLOSURE OF THE INVENTION

Problems to be Solved by the Invention

In order to thus use the prior art clip, it is necessary that a relatively large second bend section 220, 420, 620 or 820 is pressed to the surface of the sheets of a document while a relatively small first bend section 210, 410, 610 or 810 is pressed and widened by fingertips, and the end portions of the sheets are inserted into one end of the clip in the longitudinal direction thereof to nip the end portions of the sheets between the second bend section and the first bend section. In order to execute this, it was necessary to confirm the side in the longitudinal direction at which the relatively small first bend section 210, 410, 610 or 810 is located.

However, in the prior art clip, a large spacing is provided between the relatively small first bend section 210, 410, 610 or 810 located inwardly and the relatively large second bend section 220, 420, 620 or 820 located outwardly. Therefore, it is difficult for a visually-impaired person or a presbyopic person to understand at which side in the longitudinal direction the relatively small first bend section 210, 410, 610 or 810 is located since he or she recognizes by tactual sense that, with one end thereof in the longitudinal direction placed between and held by the fingers, a loop of a single wire material, which has an outwardly located relatively large second bend section 220, 420, 620 or 820 formed, is provided at one side, and even with the other end thereof in the longitudinal direction placed between and held by the fingers, a loop of the same single wire material, which has a connection section 270, 470, 670 or 870 formed, is provided at the other side. In particular, in a dark place it was difficult for a presbyopic person to detect at which side in the longitudinal direction the relatively small first bend section 210, 410, 610 or 810 is located. That is, it was difficult for a visually-impaired person or presbyopic person to confirm into which side of the clip in the longitudinal direction the end portions of the sheets are inserted. As a result, it was hard for a visually-impaired person or a presbyopic person to use the prior art clip.

Also, as shown in FIG. 2, FIG. 4, FIG. 6, and FIG. 8, the end edge of a wire material 251, 451, 651 or 851 extends outside the clip. Therefore, where a number of clips are stored in a box, there are many cases where wire materials that compose other clips adjacent to each other are brought in a spacing between the rectilinear section 230, 430, 630 or 830 of one clip and the rectilinear section 250, 450, 650 or 850 thereof through the end edge 251, 451, 651 or 851 and become entangled there. In this case, it was also hard for a visually-impaired person or a presbyopic person to pick up a clip among clips entangled with each other.

Accordingly, it is an object of the invention to provide a clip that a visually-impaired person and a presbyopic person can easily use.

Means to Solve the Objects

The clip according to one phase of this invention is, for example it is explained by showing the code of FIG. 1 in proportion to the component, a clip (100) which is composed of a wire having resiliency, comprising: first and second bend sections (110, 120) which are located at one side in the longitudinal direction, are formed of a wire material and are bent to be almost U-shaped; first and second rectilinear sections (130, 140) formed so that the wire material extends almost rectilinearly with a spacing from both ends of the first bend section (110) toward the other side in the longitudinal direction; third and fourth rectilinear sections (150, 160) formed so that the wire material almost rectilinearly extends with a spacing from both ends of the second bend section (120) toward the other side in the longitudinal direction; and a connection section (170) that connects the first rectilinear section (130) and the fourth rectilinear section (160) together at the other side in the longitudinal direction. The first rectilinear section (130) is extended and held in contact with the third rectilinear section (150) from the first bend section (110) to the connection section (170), and the fourth rectilinear section (160) is extended and held in contact with the second rectilinear section (140) from the second bend section (120) to the connection section (170). The second rectilinear section (140) and the third rectilinear section (150) have wire end edges (141 and 151) at the other end side in the longitudinal direction thereof.

The clip which consisted of it as above is equipped with next characteristic limited matter (a)-(d).

(a) The end edges (141, 151) of the second rectilinear section (140) and the third rectilinear section (150) are positioned within a region surrounded by the first rectilinear section (130), the fourth rectilinear section (160) and the connection section (170) by the first bend section (110) or the first rectilinear section (130) extending on or crossing the second bend section (120) or the third rectilinear section (150).

(b) The first bend section (110) is located almost at the same position as that of the second bend section (120) in the longitudinal direction or is located and held in proximity with the second bend section (120) with a spacing less than the diameter of a wire material.

(c) The first bend section (110) is located at a position upwardly apart from the second bend section (120) by the first rectilinear section (130) and the second rectilinear section (140) being bent upward.

(d) The first rectilinear section (130) and the third rectilinear section (150) are extended in parallel and held in contact with each other, and the second rectilinear section (140) and the fourth rectilinear section (160) are extended and held in contact with each other.

According to the clip according to one phase of this invention, it is possible to provide the following operation effectiveness (i)-(v).

(i) At first, for example, show it in FIG. 1(A), the first rectilinear section (130) is extended and held in contact with the third rectilinear section (150) from the first bend section (110) to the connection section (170). And the fourth rectilinear section (160) is extended and held in contact with the second rectilinear section (140) from the second bend section (120) to the connection section (170). Furthermore, the first rectilinear section (130) and the third rectilinear section (150) are extended in parallel and held in contact with each other, and the second rectilinear section (140) and the fourth rectilinear section (160) are extended and held in contact with each other.

And the end edges (141, 151) of the second rectilinear section (140) and the third rectilinear section (150) are positioned within a region surrounded by the first rectilinear section (130), the fourth rectilinear section (160) and the connection section (170) by the first bend section (110) or the first rectilinear section (130) extending on or crossing the second bend section (120) or the third rectilinear section (150).

Because of consisting of it in this way, for example, as shown in FIG. 1(C), when a piece of paper (10) is inserted with a clip (100), in a figure from the left, the 1st rectilinear section (130) is positioned the upper a piece of paper (10), the 3rd rectilinear section (150) is positioned the under a piece of paper (10), the 2nd rectilinear section (140) is positioned the upper a piece of paper (10), the 4th rectilinear section (160) is positioned the under a piece of paper (10), like that the position of the top and bottom is placed in alternated order.

For this reason, in the direction of the C-C line of FIG. 1(A) which intersects perpendicularly with the longitudinal direction of a clip (100) mostly, i.e., the direction, it can prevent more effectively that a clip (100) is slippery. Thereby, the pinching force over the piece of paper of a clip (100) etc. can be heightened. On the other hand, when caught piece of paper (10) with clip (200) to show it in FIG. 2(C) with conventional clip (200); in a figure from the left the third straight line region (250) of piece of paper (10) lower; the first straight line region (230) in a thing of piece of paper (10) the second straight line region (240) in a thing of piece of paper (10) the fourth straight line region (260) called the position under piece of paper (10) is placed sequentially. For this reason, in the direction of the C-C line of FIG. 2(A) which intersects perpendicularly with the longitudinal direction of a clip (200) mostly, i.e., the direction, it becomes easy to slide on a clip (200).

(ii) Moreover, according to this invention, for example, as shown in the FIG. 1 (A), the first rectilinear section (130) and the third rectilinear section (150) are extended in parallel and held in contact with each other. and the second rectilinear section (140) and the fourth rectilinear section (160) are extended and held in contact with each other. And, because the end edge (141) of the second rectilinear section (140) and the end edge (151) of the third rectilinear section (160) are positioned in the inner region of the clip (100), as shown in the FIGS. 1 (A) and (C), a space between the first rectilinear section and the second rectilinear section (130, 140) continueing to the first bend section (110) and a space between the third rectilinear section and the fourth rectilinear section (150, 160) continueing to the second bend section (120) can be made almost the same. This enables the pinching force of the clip of the present invention heightened, compared to the case in which a space between the first rectilinear section and the second rectilinear section (230, 240) continueing to the first bend section (210) and a space between the third rectilinear section and the fourth rectilinear section (250, 260) continueing to the second bend section (220) are different as the traditional clips (200).

(iii) Moreover, according to this invention, one side in the longitudinal direction, the first and the second bend section (110, 120), that is, the roop of the two wire materials are overlayed at the almost same position, or at the position close to each other with a spacing equal to or less than the diameter of the wire material of the clip. This enables the space smaller compared to the case of existence between the first and the second bend sections as the traditional clips. This enables us to save the wire material by downsizing the clips and to save the quantity of the wire material for producing clips of prescribed size.

(iv) Moreover, according to this invention, one side in the longitudinal direction, the first and the second bend section (110, 120) are located at almost the same position or at the position close to each other with a spacing equal to or less than the diameter of the wire material. That is, whereas two roops of the wire material are located at almost the same position or at the position close to each other, the other side in the longitudinal direction has connection section, that is, one roop of wire material.

As one side in the longitudinal direction and the other side in it are differently made up as above, for a visually handicapped person and a presbyope, different from the side connected to one roop of wire material, the side which is overlayed at almost the same position or at the position close to each other is confirmed to be the side of inserting the edge of paper by feeling of the fingertip. And as two roops of wire material are located at the upper and the lower position at certain interval at one side in the longitudinal direction and one roop of wire material are located at the other side in the longitudinal direction, a visually handicapped person or a presbyope can recognize not only the discrimination of one side and the other side in the longitudinal direction, but also the discrimination of upper and lower direction, ie. Front-back side easily by a feeling of fingertip. By this, one side of the loop of one wire material comprising connectin section can be easily recognized and the loop of one wire material comprising connection section, can be grabbed by fingertip, at the opposite side, inserting the end edge of slip of paper at almost the same position of the two loop of wire material, or at the overlayed side at the position close to each other with a spacing equal to or less than the diameter of the wire material, movement of clipping the end edge of slip of paper can be easily conducted.

(v) In addition to this, according to this invention, for example, as shown in the FIG. 1 (A), the first rectilinear section (130) and the third rectilinear section (150) are extended in parallel and held in contact with each other. and the second rectilinear section (140) and the fourth rectilinear section (160) are extended and held in contact with each other. and the first bend section (110) or the first rectilinear section (130) extending and crossing over the second bend section (120) or the third rectilinear section (150), the end edge (141, 151) of the second rectilinear section (140) and the third rectilinear section (150) is located in the region surrounded by the first rectilinear section (130) and the fourth rectilinear section (160) and connection section (170). Thus, the first rectilinear section (130) and the third rectilinear section (150) are extended in parallel and held in contact with each other. and the second rectilinear section (140) and the fourth rectilinear section (160) are extended and held in contact with each other. And the end edges (141, 151) of the second rectilinear section (140) and the third rectilinear section (160) are located in the inner region of a clip (100). Consequently, when many clips are stored in a box etc., space between one rectilinear section (130) and the third rectilinear section (150) which are extended in contact with each other or between the second rectilinear section (140) and the fourth rectilinear section which are extended in contact with each other through the end edge (141) of the second rectilinear section (140) or through through the end edge (121) of the second rectilinear section (150), neibouring wire material comprising other clips is prevented to get into and to become entangled. Consequently, visually handicapped person or a presbyope can easily take one clip from many clips stored in a box etc.

(2) In addition, a clip according to another aspect of this invention, in addition to the above feature of a clip according to one aspect of this invention, explaining by showing codes corresponding to the components in the FIG. 11 in parenthesis, has the following characteristic limitation (e) for example (e) At least either one of the first rectilinear section (1130) or the fourth rectilinear section (1160) (the fourth rectilinear section (1160) in drawing 11) includes a bent section (1162), a base rectilinear section (1161) or a diagonal rectilinear section (1163) that is bent via the bent section (1162) and extends upward from the base rectilinear section (1161), and the connection section (1170) is connected to the diagonal rectilinear section (1163).

According to a clip according to another aspect of this invention with the above feature, in addition to the effect of the clip according to one aspect of the invention, next effects (vi) to (x) can be obtained.

(vi) When sheets of documents clipped by a clip becomes thick, for example, in a traditional clip (800) shown in FIG. 8, a space between the first bend section (810) and the second bend section (820) becomes open largely (やや不安). as a space between the first bend section (810) and the second bend section (820) becomes open larger, torsion is added at the connection section (870). As a plastic deformation (permanent deformation) become easily to occur at the connection section by this torsion, elastic fource is lost for clipping sheets of documents by a clip. As a result, a clip is more likely to drop out from sheets of documents.

On the contrary, according to a clip according to another aspect of this invention, for example, as shown in the FIG. 11 and FIG. 13, a space between the first bend section (1110) and the second bend section (1120) becomes open wide. As a space between the first bend section (1110) and the second bend section (1120) opens wider, torsion will be added to the connection section (1170). As a plastic deformation (permanent deformation) is more likely to occur at the connection section by this torsion, elastic fource is lost for clipping sheets of documents by a clip.

However, a clip (1100) according to another aspect of this invention, thick sheets of documents (50) can be clipped and hold not only by an elastic fource at the connection section (1170), but also by an elastic fource between base rectilinear section (1161) which is bended via bend section and diagonal rectilinear section.

(vii) As a fource clipping and holding sheets of documents can be strengthened by function and effect described in (i) and (ii) as above with two elastic fource described as above, clipping fource can be more likely improved.

(vii) In this case, a stress generated in a state clipping sheets of documents (50) by a clip (1100) can be dispersed into two directions of base rectilinear section (1161) and diagonal rectilinear section (1163) using the bend section as supporting point. That is, base rectilineat section (1161) and diagonal rectilinear section (1163) via bend section functions as a stress releasing mean. Consequently, even if frequency of use of a clip is increased, fatigue of the material can be released and a limitation of fatigue can be increased as a result. Consequently, a usage life of a clip can be elongated because clipping fource to sheets of documents does not decreased even if frequency of use of a clip is increased.

(ix) Moreover, for example, as shown in the FIG. 13, the other side of the longitudinal direction, by grafing a diagonal rectilinear section (1163) continuing to connection section (1170), action clipping by inserting edge section of sheets (50) into a clip (1100) or action pulling out a clip (1100) from edge section of sheets (50) can be easily done.

(x) Moreover, for example, in the case of clipping sheets (50) by a clip as shown in the FIG. 13, by moving a clip along with a surface of sheets (50) until a diagonal rectilinear section (1163) contact to an edge of sheets, multiple sheets (50) can be clipped and fixed. Consequently, a diagonal rectilinear section (1163) can be used for an inserting stopper of a clip against sheets.

(3) Moreover, a clip according to another aspect of this invention has a following characteristic limitation matter (f) in addition to characters of a clip according to an aspect of this invention, when it is explained by showing the codes in the FIG. 11 corresponding to components in parenthesises for example.

(f) At least either one of the first rectilinear section (1130) or the fourth rectilinear section (1160) (the fourth rectilinear section (1160) in drawing 11) includes the first and second bent sections (1162, 1164), a downward rectilinear section (1161) located at a relatively downward plane, a diagonal rectilinear section (1163) that is bent via the first bent section (1162) and extends upward from the downward rectilinear section (1161), and an upper rectilinear section (1165) that is bent via the second bent section (1164), is continued to the diagonal rectilinear section (1163) and is located at a plane relatively further upward than the downward plane, and the connection section (1170) is connected to the upward rectilinear section (1165).

According to a clip according to the other aspect of this invention with characters above, following functions and effects (xi) to (xiv) can be obtained in addition to functions and effects of a clip according to one aspect of this invention.

(xi) When sheets clipped by a clip become thick, for example, in a traditional clip (80C) as shown in FIG. 8, a space between the first bend section (810) and the second bend section (820) opens wid. As a space between the first bend section (810) and the second bend section (820) opens wider, torsion is added to a connection section (870). Elastic fource for clipping sheets by a clip is lost because connection because plastic deformation (permanent deformation) become likely to occur at a connection section (870) by this torsion. As a result, a clip becames more likely to drop out from thick sheets.

On the contrary to this, according to a clip of this invention, for example, as shown in FIG. 11 and FIG. 13, a space between the first bend section (1110) and the second bend section (1129) opens wide. As a spece between the first bend section (1110) and the second bend section (1129) opens wider, torsion will be added to a connection section (1170). Elastic fource for clipping sheets by a clip is lost because connection because plastic deformation (permanent deformation) become likely to occur at a connection section (1170) by this torsion.

However, a clip (1100) of this invention can clip and maintain thick sheets (50) not only by an elastic fource clipping sheets (50) by a torsion of connection section (1170) but also by an elastic force between the lower rectililnear section (1161) and diagonal rectilinear section (1163) bended vie a first curving section (1162) and by an elastic fource between upper rectilinear section (1165) and diagonal rectilinear section (1163) bended via the second curving section (1164).

(xii) With three elastic fources described as above, as clipping and maintaining fource can be heightened by functions and effects described as above in (i) and (ii), clipping fource can be more likely to improved.

(xiii) In this case, the stress produced in the condition of having been crowded with the clip on both sides of the piece of paper can be distributed in the three directions, a base rectilinear section (1161), a diagonal rectilinear section (1163), and an upper rectilinear section, by using the first and the second bend section (1162, 1164) as the supporting point. That is, a base rectilinear section (1161) and an upper rectilinear section (1165) through the first and the second bend section (1162, 1164) act as a stress relaxation means. For this reason, even if the operating frequency of a clip becomes high, fatigue of an ingredient can be eased and a fatigue limit can be raised as a result. Since the pinching force over the piece of paper of a clip is not reduced by the even if the operating frequency of a clip becomes high, the use life of a clip can be raised.

(xiv) Moreover, for example as shown in FIG. 13, when the piece of paper (50) is inserted, it can fix by moving a clip along the front face of a piece of paper 50 until a diagonal rectilinear section (1163) contacts the edge of a piece of paper (50). Thereby the location of a diagonal rectilinear section can adjust the extent of the plague to the piece of paper of a clip. That is, a diagonal rectilinear section (1163) can be used as a plug stopper to the piece of paper of a clip.

(4) Moreover a clip according to the other phase of this invention adds a character of another phase of this invention, or a character of the clip according to the other phase of this invention, and provides a following characteristic limited matter (g) for example it is explained by showing the code of FIG. 22 in proportion to the component.

(g) The connection section (1870) includes an annular section consisting of upward-turning sections (1871, 1872) which is continued to the first rectilinear section (1830) and turns relatively upward and downward-turning sections (1873, 1874) which is continued to the fourth rectilinear section (1860) after being continued to the upward-turning sections (1871, 1872) and turning relatively downward.

The clip with the above character according to more other phase of this invention adds the operation effectiveness of a clip or the operation effectiveness of a clip according to another phase of this invention and can obtain the following effect (XV)~(Xvii).

(XV) When the piece of paper which is put with a clip becomes thick, for example a conventional clip (800) showing FIG. 8 expands largely the space between the first bend section (810) and the second bend section (820). As the space between the first bend section (810) and the second bend section becomes to expand largely, a connection section (870) adds the torsion. The torsion loses an elastic force to slip the paper by a clip to get a connection section (870) plastic deformation (permanent deformation) easily. As the result, a clip On the other hand, the clip of this invention opens largely between the first bend section and the second bend section for example as shown in FIG. 22 and FIG. 24. As the space between the first bend section (1810) and the second bend section (1820) open largely, a connection section (1870) adds the torsion. The torsion loses an elastic force to slip the paper by a clip to get a connection section (1870) plastic deformation (permanent deformation) easily.

However, the clip of this invention can clip and keep a thick piece of paper (50) not only by the elastic force by the torsion of a connection section (1870) but also by the elastic force to clip a piece of paper (50) by annular section consists of upward-turning sections (1871,1872) and downward-turning sections (1873,1874) or, by the elastic force to clip a piece of paper (50) under spring action of annular section.

And even if the elastic force to clip apiece of paper (50) under spring action of annular section is lost by plastic deformation (permanent deformation), the elastic force described the above (vi) or (xi) can clip and keep thick documents.

(xvii) As well as the above elastic forces, even the operation effectiveness described on the above (i) and (ii) strengthen the force to clip and keep documents.

(xvii) Moreover in this case, as described on FIG. 22, the annular section consisting of upward-turning sections (1871, 1872) and downward-turning sections (1873,1874) constructing a connection section is operated as a stress relaxation means. For this reason, even if the frequency in use of a clip becomes high, fatigue of an ingredient can be eased and a fatigue limit can be raised as a result. Since the pinching force over the piece of paper is not reduced by this, even if the frequency in use of a clip becomes high, the use life of a clip can be raised.

Effects of the Invention

As described above, according to the invention, it is possible to provide a clip that can be made small-sized, can minimize the quantity of wire materials necessary to produce a clip of a predetermined size, can increase its nipping or holding force for sheets and cloth, and can be easily used by a visually-impaired person and a presbyopic person.

DESCRIPTION OF SYMBOLS

100: Clip, 110: First bend section, 120: Second bend section, 130: First rectilinear section, 131, 161: Base rectilinear sections, 132, 162: Bent sections, 133, 163: Diagonal rectilinear sections, 140: Second rectilinear section, 141,151: End edges, 150: Third rectilinear section, 160: Fourth rectilinear section, 170: Connection section

BEST MODE FOR CARRYING OUT THE INVENTION

Hereafter, the embodiment of this invention is explained based on drawings.

Figure 1:
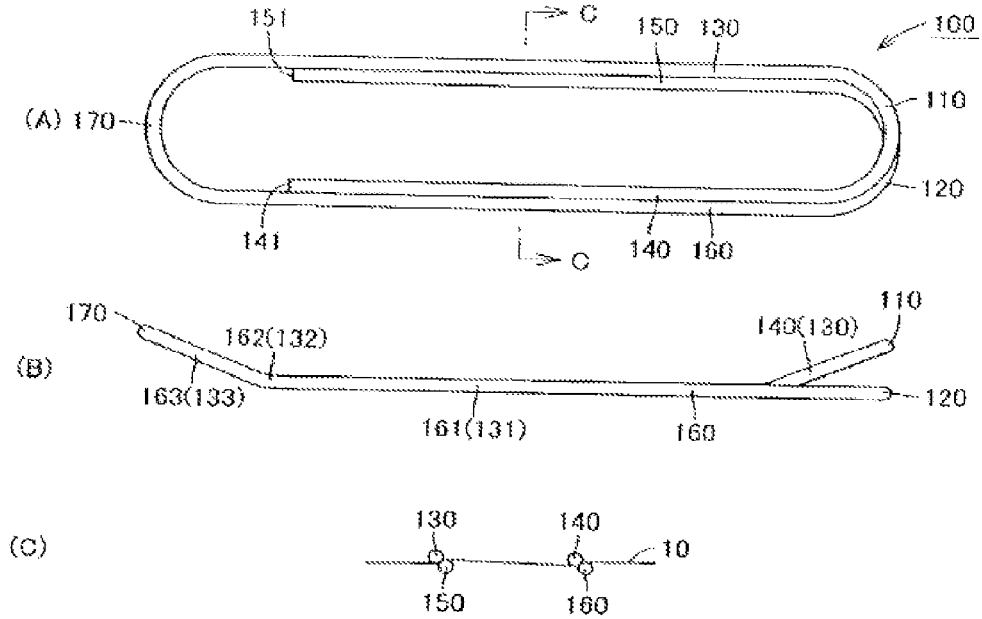
[FIG. 1] In the respective accompanying drawings, (A) is a plan view showing Embodiment 1 of a clip according to the invention, (B) is a front elevational view thereof, and (C) is a cross sectional view taken along the line C-C of plan view (A), which shows a clip between which sheets of paper are nipped and held.
Figure 2:
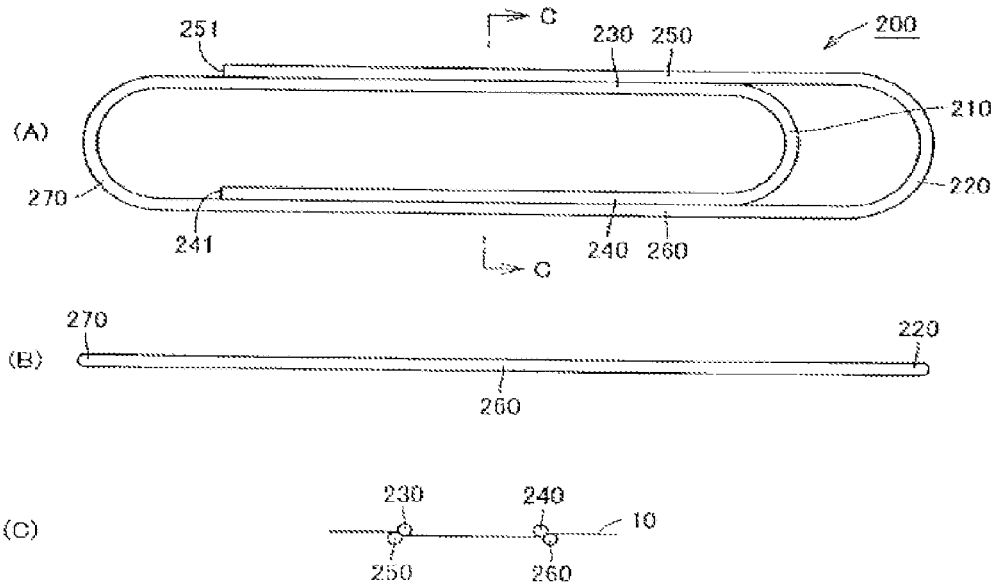
Fig.2 Prior Art
[FIG. 2] It is the sectional view (C) in the C-C line of a top view (A) showing the clip in the condition of having inserted the top view (A) showing the conventional embodiment 1 of a clip, a front view (B), and paper.

FIG. 1 is the top view (A), a front view (B) and the sectional view (C) in the C-C line of a top view (A) showing the clip in the condition of having inserted with sheets, showing the embodiment of the 1st of the clip of this invention. It is FIG. 2 is the top view (A) showing the conventional embodiment 1 of a clip, a front view (B), and the sectional view (C) in the C-C line of a top view (A) showing the clip in the condition of clipping papers, for a comparison.

As shown in FIG. 1, a clip 100 is a clip which consists of a wire material which has elasticity. The clip 100 of this invention is equipped with the 1st bend section 110, the 2nd bend section 120, the 1st rectilinear section 130 and the 2nd rectilinear section 140, the 3rd rectilinear section 150 and the 4th rectilinear section 160, and the connection section 170. It is located in the one side (it sets to FIG. 1 and is right-hand side) of a longitudinal direction, a wire material is bent by the about U character configuration, and the 1st bend section 110 and the 2nd bend section 120 are mostly formed in the shape of a hemicycle. The 1st rectilinear section 130 and the 2nd rectilinear section 140 are formed so that a wire material may open spacing toward the other side (it sets to FIG. 1 and is left-hand side) of a longitudinal direction from the both ends of the 1st bend section 110 and it may extend in the shape of a straight line mostly. The 3rd rectilinear section 150 and the 4th rectilinear section 160 are formed so that a wire material may open spacing toward the other side of a longitudinal direction from the both ends of the 2nd bend section 120 and it may extend in the shape of a straight line mostly. The connection section 170 connected the 1st rectilinear section 130 and the 4th rectilinear section 160 in the other side of a longitudinal direction, the wire material was bent by the about U character configuration, and it was mostly formed in the shape of a hemicycle, and it is extended so that spacing between the 1st rectilinear section 130 and the 4th rectilinear section 160 may be straddled.

The 3rd rectilinear section 150 was approached and the 1st rectilinear section 130 is extended until it results [from the 1st bend section 110] in the connection section 170. The 2nd rectilinear section 140 was approached and the 4th rectilinear section 160 is extended until it results [from the 2nd bend section 120] in the connection section 170.

The 2nd rectilinear section 140 and the 3rd rectilinear section 150 have the end edge of a wire material in the other side of a longitudinal direction. When the 1st bend section 110 extends and crosses on the 2nd bend section 120, the end edge 141 of the 2nd rectilinear section 140 and the end edge 151 of the 3rd rectilinear section 150 are positioned in the field enclosed by the 1st rectilinear section 130, the 4th rectilinear section 160, and the connection section 170.

The 1st bend section 110 is positioned in the almost same location as the 2nd bend section 120 in the longitudinal direction. By bending the 1st rectilinear section 130 and the 2nd rectilinear section 140 up, the 1st bend section 110 is positioned in the upper location distant from the 2nd bend section 120.

The 1st rectilinear section 130 has bend section 132 in the other side of a longitudinal direction, and the 4th rectilinear section 160 has bend section 162 in the other side of a longitudinal direction. The 1st rectilinear section 130 has the single bend section 132, and contains the base rectilinear section 131 and the method rectilinear section 133 of slanting which is bent through the single bend section 132 and extended in the upper part from the base rectilinear section 131. The connection section 170 is following the method rectilinear section 133 of slanting. The 4th rectilinear section 160 has the single bend section 162, and contains the base rectilinear section 161 and the method rectilinear section 163 of slanting which is bent through the single bend section 162 and extended in the upper part from the base rectilinear section 161. The connection section 170 is following the method rectilinear section 163 of slanting.

On the other hand, as shown in FIG. 2, although the conventional clip 200 is equipped with the 1st bend section 210, the 2nd bend section 220, the 1st rectilinear section 230 and the 2nd rectilinear section 240, the 3rd rectilinear section 250 and the 4th rectilinear section 260, and the connection section 270, it has the configuration which carried out flat as a whole as shown in FIG. 2 (B). There is big space between the 1st bend section 210 and the 2nd bend section 220 relatively. Although the end edge 241 of the 2nd rectilinear section 240 is positioned in the field enclosed by the 1st rectilinear section 230, the 4th rectilinear section 260, and the connection section 270, the end edge 251 of the 3rd rectilinear section 250 has extended on the outside of a clip 200.

The clip 100 shown in FIG. 1 does the following operation effectiveness so as an advantage over the conventional clip 200 shown in FIG. 2.

First, in the clip 100 of this invention, the 1st bend section 110 is positioned in the almost same location as the 2nd bend section 120 in the longitudinal direction by the one side of a longitudinal direction. By bending the 1st rectilinear section 130 and the 2nd rectilinear section 140 up, the 1st bend section 110 is positioned in the upper location distant from the 2nd bend section 120 in the one side of a longitudinal direction. On the other hand, in the other side of a longitudinal direction, the connection section 170 which connects the 1st rectilinear section 130 and the 4th rectilinear section 160 is positioned, and both the 1st rectilinear section 130 and the 4th rectilinear section 160 have bend sections 132 and 162.

Thus, to the 1st bend section 110 and the 2nd bend section 120 being in the almost same location, namely, there being two loop formations of a wire material in the same location, by the other side of a longitudinal direction, there is the connection section 170, namely, there is only one loop formation of a wire material at the one side of a longitudinal direction. Moreover, at the one side of a longitudinal direction, two rectilinear sections connected with one loop formation of a wire material are crooked by the other side of a longitudinal direction to the 1st bend section 110 being in the upper location distant from the 2nd bend section 120, namely, two loop formations of a wire material having lapped.

In the clip 100 of this invention, it consists of embodiment from which the one side of a longitudinal direction and the other side differed as mentioned above. For this reason, unlike the side in which two rectilinear sections connected with one loop formation of a wire material are crooked, for a visually handicapped person or the man of a presbyopia, the side with which two loop formations of a wire material have lapped in the almost same location can check easily that it is the side which inserts the edge of a piece of paper with the touch of a fingertip. The edge of a piece of paper can be inserted in the side to which the one loop-formation side of a wire material which constitutes the connection section 170 could be easily checked by this, one loop formation of a wire material which constitutes the connection section 170 has been held by the fingertip, and two loop formations of a wire material have lapped with the connection section 170 in the almost same location in the opposite side, and actuation which puts the edge of a piece of paper can be performed easily.

Moreover, in the one side of a longitudinal direction, since the 1st bend section 110 and the 2nd bend section 120, i.e., two loop formations of a wire material, have lapped in the almost same location, compared with predetermined space existing, the space can be made small between the 1st bend section 210 and the 2nd bend section 220 like the conventional clip 200. For this reason, a clip can be miniaturized and the amount of a wire material required to manufacture the clip of predetermined magnitude can be saved.

Furthermore, in the one side of a longitudinal direction, since the 1st bend section 110 is in the upper location distant from the 2nd bend section 120, namely, there are two loop formations of a wire material in the upper part and the caudad distant location at the predetermined spacing, the edge of a piece of paper can be inserted in the spacing, and actuation which puts the edge of a piece of paper can be performed easily.

In the other side of a longitudinal direction, since two rectilinear sections connected with one loop formation of a wire material are crooked, by holding the bend sections 132 and 162, the edge of a piece of paper can be inserted between the connection section 170, the 1st bend section 110 of the opposite side, and the 2nd bend section 120, and actuation which puts the edge of a piece of paper can be performed easily.

Since there are two loop formations of a wire material in the upper part and the caudad distant location at the predetermined spacing and there is a loop formation of a wire material in the other side of a longitudinal direction, a visually handicapped person and the man of a presbyopia can recognize easily not only distinction of the one side of a longitudinal direction, and the other side but distinction of the vertical direction of a clip 100, i.e., a front background, with the touch of a fingertip at the one side of a longitudinal direction further again.

In the clip of this invention, when the 1st bend section 110 extends and crosses on the 2nd bend section 120, the end edge 141 of the 2nd rectilinear section 140 and the end edge 151 of the 3rd rectilinear section 150 are positioned in the field enclosed by the 1st rectilinear section 130, the 4th rectilinear section 160, and the connection section 170. Thus, the end edge 141 of the 2nd rectilinear section 140 and the end edge 151 of the 3rd rectilinear section 150 are positioned in the field inside a clip 100. For this reason, when many clips 100 are kept by the box etc. In one clip 100, approach mutually and in the clearance between the 1st rectilinear section 130 and the 3rd rectilinear section 150 which are extended Or it can prevent that the wire material which constitutes other clips 100 which approach mutually and adjoin each other between the 2nd rectilinear section 140 and the 4th rectilinear section 160 which are extended through the end edge 141 of the 2nd rectilinear section 140 or the end edge 151 of the 3rd rectilinear section 150 enters and twines. Thereby, a visually handicapped person and the man of a presbyopia can take out one clip 100 easily among many clips 100 currently kept by the box etc.

Moreover, since the end edge 141 of the 2nd rectilinear section 140 and the end edge 151 of the 3rd rectilinear section 150 are positioned in the field inside a clip 100, spacing of the 1st rectilinear section 130 which follows the 1st bend section 110, and the 2nd rectilinear section 140, and spacing of the 3rd rectilinear section 150 which follows the 2nd bend section 120, and the 4th rectilinear section 160 can be made almost the same. For this reason, compared with what has the 1st small bend section 210 relatively [inside] like the conventional clip 200, and has the 2nd big bend section 220 relatively [outside], a clip can be miniaturized and the amount of a wire material required to manufacture the clip of predetermined magnitude can be saved.

Furthermore, since the end edge 141 of the 2nd rectilinear section 140 and the end edge 151 of the 3rd rectilinear section 150 are positioned in the field inside a clip 100, as shown in FIG. 1(C), when a piece of paper 10 is inserted with a clip 100, in a figure from the left, the 1st rectilinear section 130 is positioned the upper apiece of paper 10, the 3rd rectilinear section 150 is positioned the under a piece of paper 10, the 2nd rectilinear section 140 is positioned the upper a piece of paper 10, the 4th rectilinear section 160 is positioned the under a piece of paper 10, like that the position of the top and bottom is placed in alternated order.

For this reason, in the direction of the C-C line of FIG. 1 (A) which intersects perpendicularly with the longitudinal direction of a clip 100 mostly, i.e., the direction, it can prevent more effectively that a clip 100 is slippery. Thereby, the pinching force over the piece of paper of a clip 100 etc. can be heightened.

On the other hand, when caught piece of paper 10 with clip 200 to show it in FIG. 2(C) with conventional clip 200; in a figure from the left the third straight line region 250 of piece of paper 10 lower; the first straight line region 230 in a thing of piece of paper 10 the second straight line region 240 in a thing of piece of paper 10 the fourth straight line region 260 called the position under piece of paper 10 is placed sequentially. For this reason, in the direction of the C-C line of FIG. 2(A) which intersects perpendicularly with the longitudinal direction of a clip 200 mostly, i.e., the direction, it becomes easy to slide on a clip 200.

Moreover, about the clip 100 of this invention, both the 1st rectilinear section 130 and the 4th rectilinear section 160 have the single bend sections 132 and 162. And the connection section 170 is following these method diagonal rectilinear sections 133 and 163 of slanting including the base rectilinear sections 131 and 161 and the method diagonal rectilinear sections 133 and 163 of slanting which are bent through the single bend sections 132 and 162 and are extended in the upper part from the base rectilinear sections 131 and 161.

When a piece of paper is inserted with a clip 100 by doing in this way, on both sides of two or more pieces of paper, it can fix by moving a clip 100 along the front face of a piece of paper until the method diagonal rectilinear sections 133 and 163 of slanting contact the edge of a piece of paper. Thereby, the method diagonal rectilinear sections 133 and 163 of slanting can be used as a plug stopper to the piece of paper of a clip 100.

Moreover, the stress produced in the condition of having been crowded with the clip 100 on both sides of the piece of paper in this case can be distributed in the two directions of the base rectilinear sections 131 and 161 and the method diagonal rectilinear sections 133 and 163 of slanting by using bend sections 132 and 162 as the supporting point. That is, the base rectilinear sections 131 and 161 through bend sections 132 and 162 and the method diagonal rectilinear sections 133 and 163 of slanting act as a stress relaxation means. For this reason, even if the operating frequency of a clip 100 becomes high, fatigue of an ingredient can be eased and a fatigue limit can be raised as a result. Since the pinching force over the piece of paper of a clip 100 is not reduced by this even if the operating frequency of a clip 100 becomes high, the use life of a clip 100 can be raised.

Furthermore, in the other side of a longitudinal direction, actuation which inserts and puts the edge of apiece of paper between a clip 100, or actuation which samples a clip from the edge of a piece of paper can be easily performed by holding the method diagonal rectilinear sections 133 and 163 of slanting which are following the connection section 170.

Figure 3:
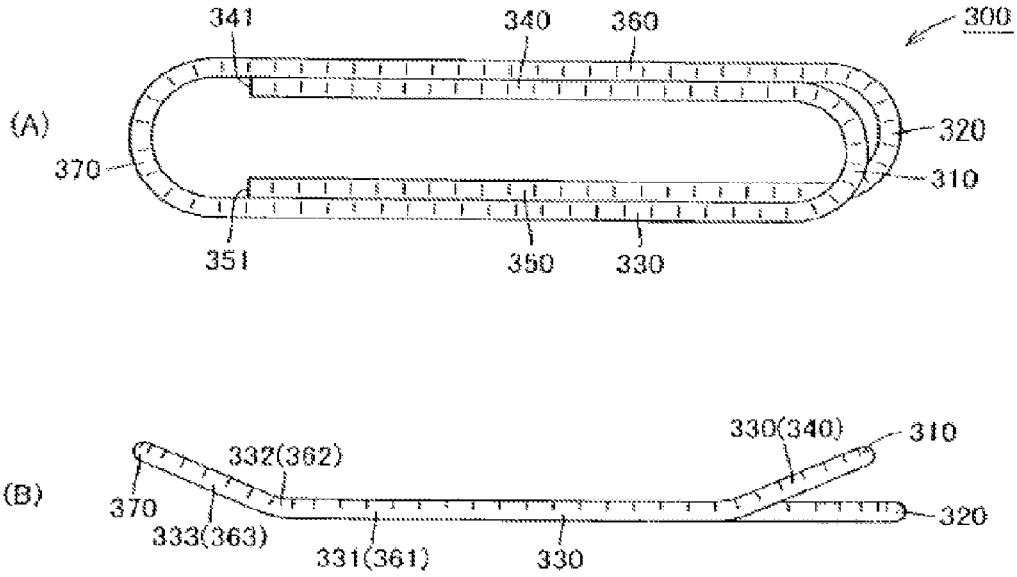
[FIG. 3] It is the top view (A) and front view (B) showing the embodiment of the 2nd of the clip of this invention.
Figure 4:
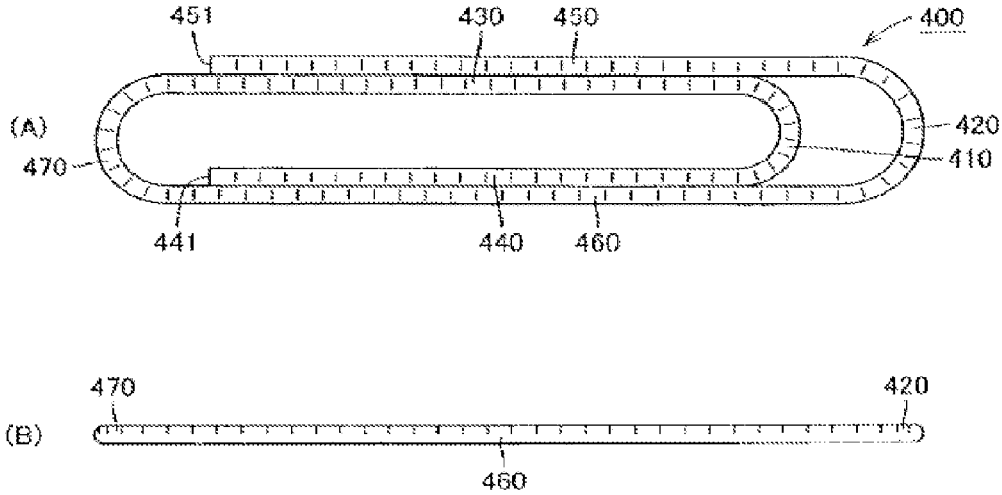
Fig.4 Prior Art
[FIG. 4] It is the top view (A) and front view (B) showing the conventional embodiment 2 of a clip.

FIG. 3 is the top view (A) and front view (B) showing the embodiment of the 2nd of the clip of this invention. It is the top view (A) and front view (B) in which FIG. 4 shows the conventional embodiment 2 of a clip for a comparison.

As shown in FIG. 3, a clip 300 is a clip which consists of a wire material which has elasticity. The clip 300 of this invention is equipped with the 1st bend section 310, the 2nd bend section 320, the 1st rectilinear section 330 and the 2nd rectilinear section 340, the 3rd rectilinear section 350 and the 4th rectilinear section 360, and the connection section 370. The 1st rectilinear section 330 and the 4th rectilinear section 360 have the base rectilinear sections 331 and 361, bend sections 332 and 362, and the method diagonal rectilinear sections 333 and 363 of slanting, respectively. The 2nd rectilinear section 340 and the 3rd rectilinear section 350 have the end edges 341 and 351, respectively.

In order unlike the clip 100 shown in FIG. 1 to insert a thick piece of paper etc. and to use, as a skid, two or more slots open spacing in the peripheral face of a wire material, and are formed in it. Moreover, the 1st bend section 310 is the location which approached the 2nd bend section 320 in the longitudinal direction, and is positioned inside by other side approach in the longitudinal direction rather than the 2nd bend section 320. When the 1st bend section 310 extends and crosses on the 2nd bend section 320 and the 3rd rectilinear section 350, the end edge 341 of the 2nd rectilinear section 340 and the end edge 351 of the 3rd rectilinear section 350 are positioned in the field enclosed by the 1st rectilinear section 330, the 4th rectilinear section 360, and the connection section 370. In the clip 300 of this invention, spacing of the longitudinal direction between the 1st bend section 310 and the 2nd bend section 320 is below the diameter of a wire material.

The configuration of others of a clip 300 is the same as the configuration of the clip 100 shown in FIG. 1.

On the other hand, as shown in FIG. 4, although the conventional clip 400 is equipped with the 1st bend section 410, the 2nd bend section 420, the 1st rectilinear section 430 and the 2nd rectilinear section 440, the 3rd rectilinear section 450 and the 4th rectilinear section 460, and the connection section 470, it has the configuration which carried out flat as a whole as shown in FIG. 4(B). There is big space between the 1st bend section 410 and the 2nd bend section 420 relatively. Although the end edge 441 of the 2nd rectilinear section 440 is positioned in the field enclosed by the 1st rectilinear section 430, the 4th rectilinear section 460, and the connection section 470, the end edge 451 of the 3rd rectilinear section 450 has extended on the outside of a clip 400.

As an advantage over the conventional clip 400 shown in FIG. 4, the clip 300 shown in FIG. 3 is added to the same operation effectiveness as the clip 100 of FIG. 1, and does the following operation effectiveness so.

Although the 1st bend section 310 of a clip 300 is in the location which approached the 2nd bend section 320 in the longitudinal direction and spacing of the longitudinal direction between the 1st bend section 310 and the 2nd bend section 320 is below the diameter of a wire material Since the 1st bend section 310 and the 2nd bend section 320, i.e., two loop formations of a wire material, can be overlapped in the one side of a longitudinal direction in the location which approached Even in this case, a clip can be made small and the amount of a wire material required to manufacture the clip of predetermined magnitude can be saved. In this case, about 3 or less times of the diameter of a wire material are sufficient as spacing of the longitudinal direction between the 1st bend section 310 and the 2nd bend section 320.

Moreover, unlike the side in which two rectilinear sections connected with one loop formation of a wire material are crooked, for a visually handicapped person or the man of a presbyopia, the side which has lapped in the location where two loop formations of a wire material approached can check more easily that it is the side which inserts the edge of apiece of paper with the touch of a fingertip in this case.

Figure 5:
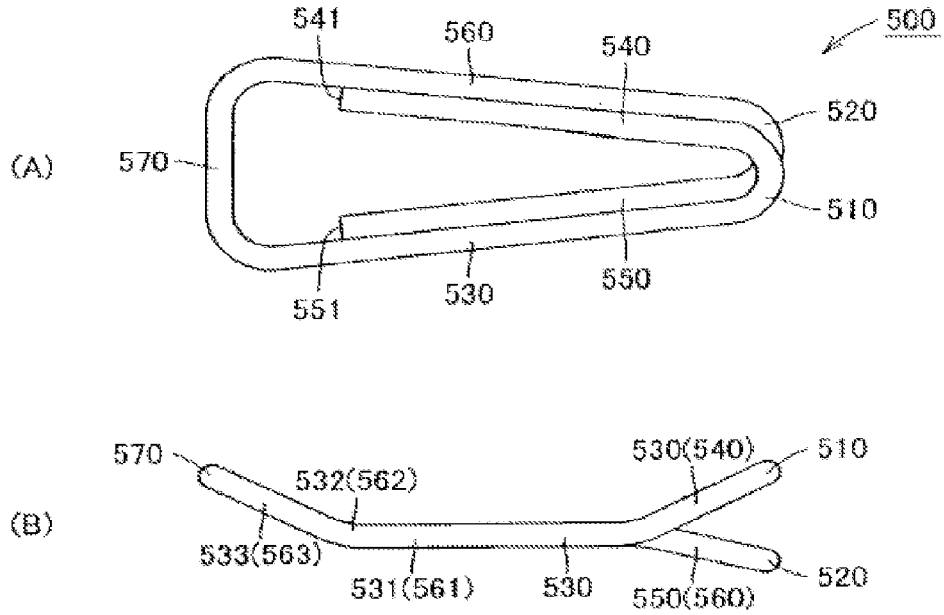
[FIG. 5] It is the top view (A) and front view (B) showing the embodiment of the 3rd of the clip of this invention.
Figure 6:
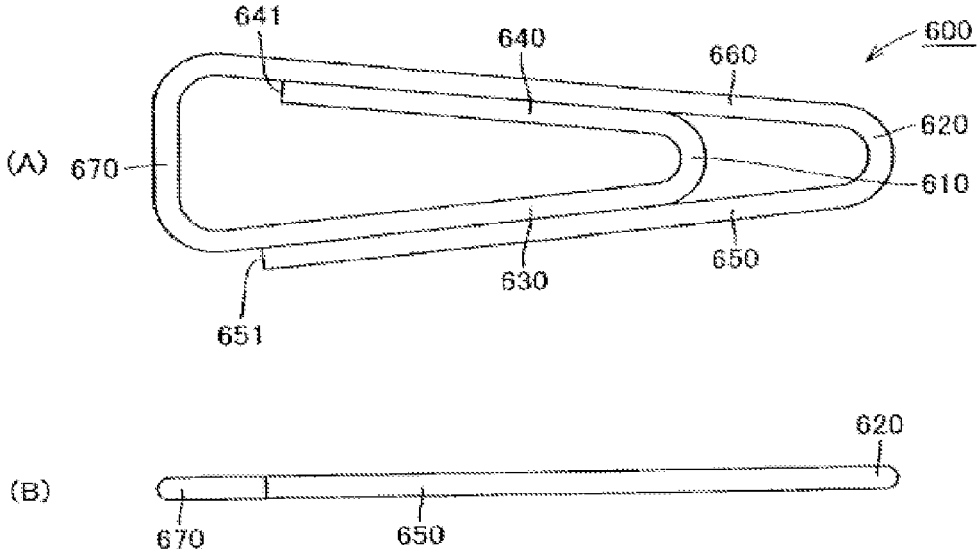
Fig.6 Prior Art
[FIG. 6] It is the top view (A) and front view (B) showing the conventional embodiment 3 of a clip.

FIG. 5 is the top view (A) and front view (B) showing the embodiment of the 3rd of the clip of this invention. It is the top view (A) and front view (B) in which FIG. 6 shows the conventional embodiment 3 of a clip for a comparison.

As shown in FIG. 5, a clip 500 is a clip which consists of a wire material which has elasticity. The clip 500 of this invention is equipped with the 1st bend section 510, the 2nd bend section 520, the 1st rectilinear section 530 and the 2nd rectilinear section 540, the 3rd rectilinear section 550 and the 4th rectilinear section 560, and the connection section 570. The 1st rectilinear section 530 and the 4th rectilinear section 560 have the base rectilinear sections 531 and 561, bend sections 532 and 562, and the method diagonal rectilinear sections 533 and 563 of slanting, respectively. The 2nd rectilinear section 540 and the 3rd rectilinear section 550 have the end edges 541 and 551, respectively.

Unlike the clip 100 shown in FIG. 1, the overall flat-surface configuration of a clip 500 is an about 2 equilateral Misumi configuration, and by the one side of a longitudinal direction, a wire material is bent, the 1st bend section 510 and the 2nd bend section 520 are formed so that the top-most vertices of an isosceles triangle may be rounded off, and in accordance with the base of an isosceles triangle, the straight-line-like connection section 570 is formed at the other side of a longitudinal direction. In a clip 500, moreover, by bending the 1st rectilinear section 530 and the 2nd rectilinear section 540 up By bending the 3rd rectilinear section 550 and the 4th rectilinear section 560 caudad it is not only positioned in the upper location where the 1st bend section 510 separated from the 2nd bend section 520, but The 2nd bend section 520 is positioned in the location of the lower part which is separated from the 1st bend section 510, and the distance between the 1st bend section 510 and the 2nd bend section 520 is large.

The configuration of others of a clip 500 is the same as the configuration of the clip 100 shown in FIG. 1.

On the other hand, as shown in FIG. 6, although the conventional clip 600 is equipped with the 1st bend section 610, the 2nd bend section 620, the 1st rectilinear section 630 and the 2nd rectilinear section 640, the 3rd rectilinear section 650 and the 4th rectilinear section 660, and the connection section 670, it has the configuration which carried out flat as a whole as shown in FIG. 6(B). There is big space between the 1st bend section 610 and the 2nd bend section 620 relatively. Although the end edge 641 of the 2nd rectilinear section 640 is positioned in the field enclosed by the 1st rectilinear section 630, the 4th rectilinear section 660, and the connection section 670, the end edge 651 of the 3rd rectilinear section 650 has extended on the outside of a clip 600.

The clip 500 shown in FIG. 5 has the same operation effectiveness as the clip 100 of FIG. 1 as an advantage over the conventional clip 600 shown in FIG. 6.

Figure 7:
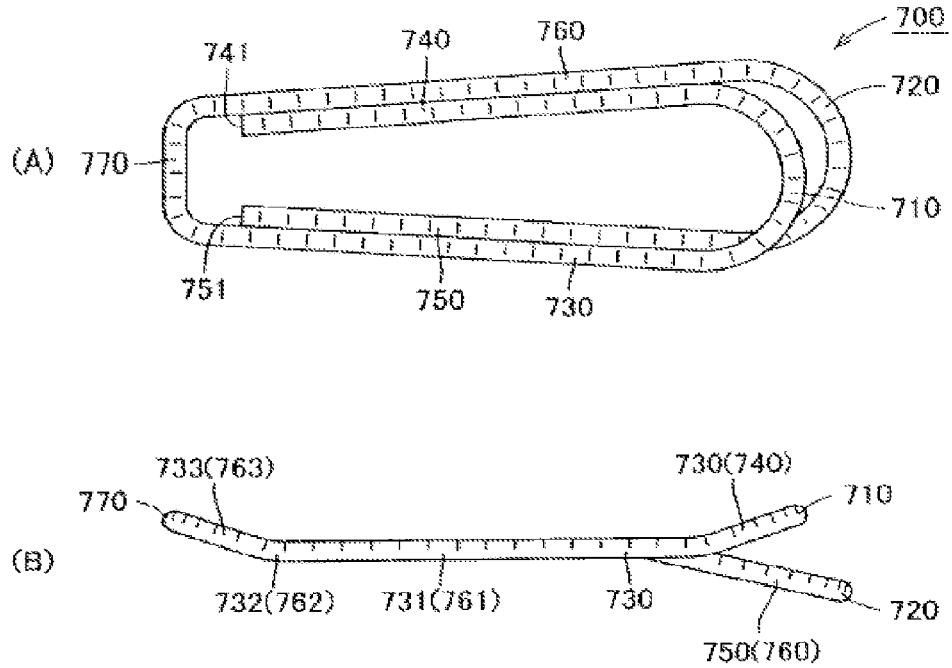
[FIG. 7] It is the top view (A) and front view (B) showing the embodiment of the 4th of the clip of this invention.
Figure 8:
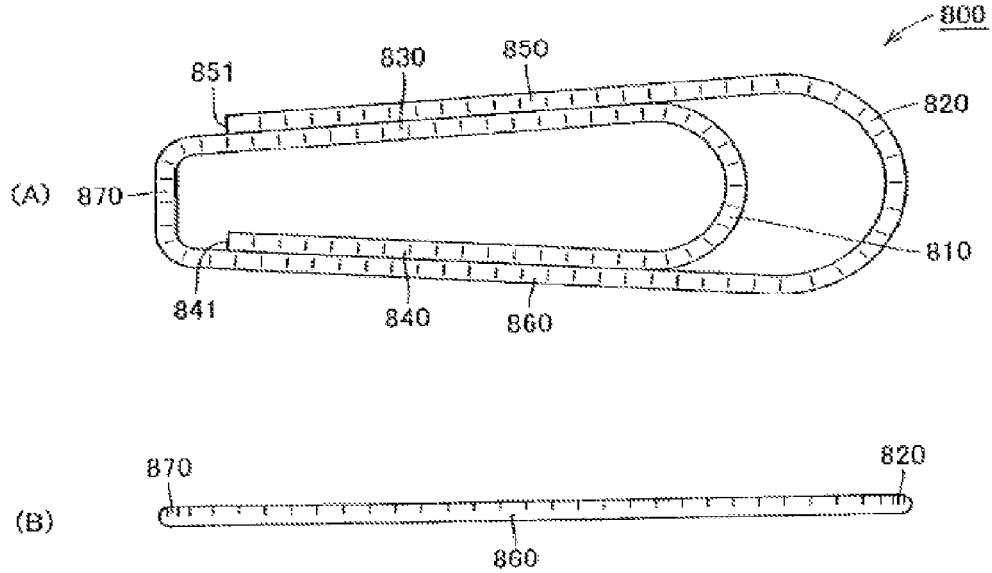
Fig.8 Prior Art
[FIG. 8] It is the top view (A) and front view (B) showing the conventional embodiment 4 of a clip.

FIG. 7 is the top view (A) and front view (B) showing the embodiment of the 4th of the clip of this invention. It is the top view (A) and front view (B) in which FIG. 8 shows the conventional embodiment 4 of a clip for a comparison.

As shown in FIG. 7, a clip 700 is a clip which consists of a wire material which has elasticity. The clip 700 of this invention is equipped with the 1st bend section 710, the 2nd bend section 720, the 1st rectilinear section 730 and the 2nd rectilinear section 740, the 3rd rectilinear section 750 and the 4th rectilinear section 760, and the connection section 770. The 1st rectilinear section 730 and the 4th rectilinear section 760 have the base rectilinear sections 731 and 761, bend sections 732 and 762, and the method diagonal rectilinear sections 733 and 763 of slanting, respectively. The 2nd rectilinear section 740 and the 3rd rectilinear section 750 have the end edges 741 and 751, respectively.

Unlike the clip 300 shown in FIG. 3, by the one side of a longitudinal direction, a wire material is relatively bent with big radius of curvature, the 1st bend section 710 and the 2nd bend section 720 are formed, and, as for the overall flat-surface configuration of a clip 700, the connection section 770 of the shape of a straight line of short die length is relatively formed rather than the width of face of one side at the other side of a longitudinal direction. In a clip 700, moreover, by bending the 1st rectilinear section 730 and the 2nd rectilinear section 740 up By bending the 3rd rectilinear section 750 and the 4th rectilinear section 760 caudad it is not only positioned in the upper location where the 1st bend section 710 separated from the 2nd bend section 720, but The 2nd bend section 720 is positioned in the location of the lower part which is separated from the 1st bend section 710, and the distance between the 1st bend section 710 and the 2nd bend section 720 is large.

The configuration of others of a clip 700 is the same as the configuration of the clip 300 shown in FIG. 3.

On the other hand, as shown in FIG. 8, although the conventional clip 800 is equipped with the 1st bend section 810, the 2nd bend section 820, the 1st rectilinear section 830 and the 2nd rectilinear section 840, the 3rd rectilinear section 850 and the 4th rectilinear section 860, and the connection section 870, it has the configuration which carried out flat as a whole as shown in FIG. 8(B). There is big space between the 1st bend section 810 and the 2nd bend section 820 relatively. Although the end edge 841 of the 2nd rectilinear section 840 is positioned in the field enclosed by the 1st rectilinear section 830, the 4th rectilinear section 860, and the connection section 870, the end edge 851 of the 3rd rectilinear section 850 has extended on the outside of a clip 800.

The clip 700 shown in FIG. 7 has the same operation effectiveness as the clip 300 of FIG. 3 as an advantage over the conventional clip 800 shown in FIG. 8.

Figure 9:
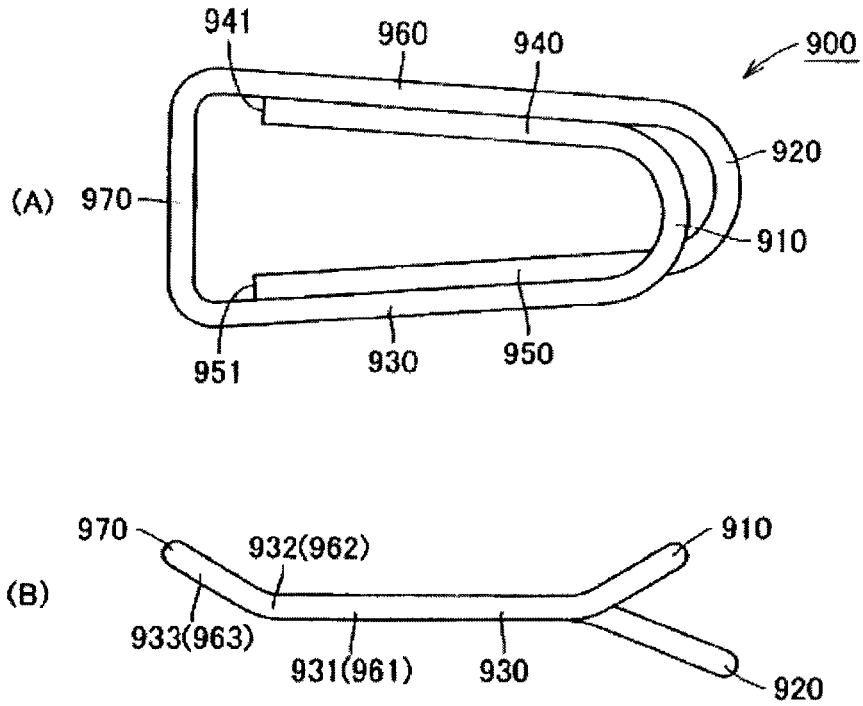
[FIG. 9] It is the top view (A) and front view (B) showing the embodiment of the 5th of the clip of this invention.

FIG. 9 is the top view (A) and front view (B) showing the embodiment of the 5th of the clip of this invention.

As shown in FIG. 9, a clip 900 is a clip which consists of a wire material which has elasticity. The clip 900 of this invention is equipped with the 1st bend section 910, the 2nd bend section 920, the 1st rectilinear section 930 and the 2nd rectilinear section 940, the 3rd rectilinear section 950 and the 4th rectilinear section 960, and the connection section 970. The 1st rectilinear section 930 and the 4th rectilinear section 960 have the base rectilinear sections 931 and 961, bend sections 932 and 962, and the method diagonal rectilinear sections 933 and 963 of slanting, respectively. The 2nd rectilinear section 940 and the 3rd rectilinear section 950 have the end edges 941 and 951, respectively.

Unlike the clip 500 shown in FIG. 5, although the overall flat-surface configurations of a clip 900 are about 2 equilateral triangles-like, by the one side of a longitudinal direction, a wire material is relatively bent with big radius of curvature, the 1st bend section 910 and the 2nd bend section 920 are formed, and the connection section 970 of the shape of a straight line of long die length is relatively formed rather than the width of face of one side at the other side of a longitudinal direction. Moreover, the 1st bend section 910 is the location which approached the 2nd bend section 920 in the longitudinal direction, and is positioned inside by other side approach in the longitudinal direction rather than the 2nd bend section 920. When the 1st bend section 910 extends and crosses on the 2nd bend section 920 and the 3rd rectilinear section 950, the end edge 941 of the 2nd rectilinear section 940 and the end edge 951 of the 3rd rectilinear section 950 are positioned in the field enclosed by the 1st rectilinear section 930, the 4th rectilinear section 960, and the connection section 970. In the clip 900 of this invention, spacing of the longitudinal direction between the 1st bend section 910 and the 2nd bend section 920 is diameter extent of a wire material.

The configuration of others of a clip 900 is the same as the configuration of the clip 500 shown in FIG. 5.

The clip 900 shown in FIG. 9 has the same operation effectiveness as the clip 700 of FIG. 7.

Figure 10:
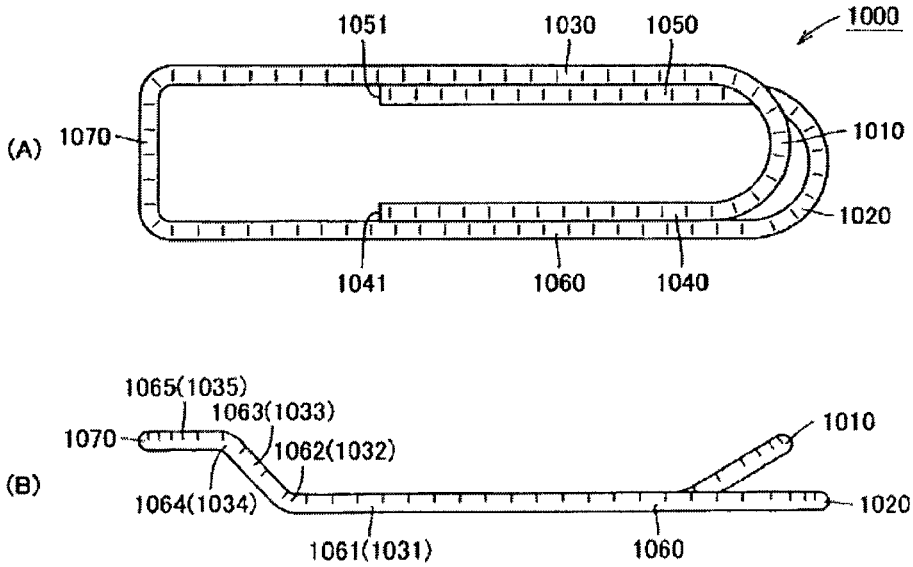
[FIG. 10] It is the top view (A) and front view (B) showing the embodiment of the 6th of the clip of this invention.

FIG. 10 is the top view (A) and front view (B) showing the embodiment of the 6th of the clip of this invention.

As shown in FIG. 10, a clip 1000 is a clip which consists of a wire material which has elasticity. The clip 1000 of this invention is equipped with the 1st bend section 1010, the 2nd bend section 1020, the 1st rectilinear section 1030 and the 2nd rectilinear section 1040, the 3rd rectilinear section 1050 and the 4th rectilinear section 1060, and the connection section 1070. The 2nd rectilinear section 1040 and the 3rd rectilinear section 1050 have the end edges 1041 and 1051, respectively.

Unlike the clip 700 shown in FIG. 7, although the overall flat-surface configuration of a clip 1000 is a rectangle-like mostly, by the one side of a longitudinal direction, a wire material is bent for a slightly small curvature diameter more relatively than a rectangular shorter side, the 1st bend section 1010 and the 2nd bend section 1020 are formed, and the connection section 1070 of the shape of a straight line of die-length extent of a rectangular shorter side is formed by the other side of a longitudinal direction.

Moreover, it sets to the clip 1000 of this invention. The lower rectilinear section 1031 which the 1st rectilinear section 1030 has the 1st and the 2nd bend section 1032 and 1034, and was relatively positioned in the downward flat surface, The method rectilinear section 1033 of slanting which is bent through the 1st bend section 1032 and extended in the upper part from the lower rectilinear section 1031, and the upper rectilinear section 1035 after being bent through the 2nd bend section 1034 and being relatively positioned in an upper flat surface rather than a lower part flat surface succeeding the method rectilinear section 1033 of slanting are included. The lower rectilinear section 1061 which the 4th rectilinear section 1060 has the 1st and the 2nd bend section 1062 and 1064, and was relatively positioned in the downward flat surface, The method rectilinear section 1063 of slanting which is bent through the 1st bend section 1062 and extended in the upper part from the lower rectilinear section 1061, and the upper rectilinear section 1065 after being bent through the 2nd bend section 1064 and being relatively positioned in an upper flat surface rather than a lower part flat surface succeeding the method rectilinear section 1063 of slanting are included. The connection section 1070 is following the upper rectilinear section 1035 and 1065.

The configuration of others of a clip 1000 is the same as the configuration of the clip 700 shown in FIG. 7.

The clip 1000 shown in FIG. 10 is added to the same operation effectiveness as the clip 700 of FIG. 7, and does the following operation effectiveness so.

When a piece of paper is inserted with a clip 1000, on both sides of two or more pieces of paper, it can fix by moving a clip 1000 along the front face of a piece of paper until the method diagonal rectilinear sections 1033 and 1063 of slanting contact the edge of a piece of paper. Thereby, the location of the method diagonal rectilinear sections 1033 and 1063 of slanting can adjust extent of the plug to the piece of paper of a clip 1000. That is, the method diagonal rectilinear sections 1033 and 1063 of slanting can be used as a plug stopper to the piece of paper of a clip 1000.

Moreover, the stress produced in the condition of having been crowded with the clip 1000 on both sides of the piece of paper in this case can be distributed in the three directions, the lower rectilinear section 1031 and 1061, the method diagonal rectilinear sections 1033 and 1063 of slanting, and the upper rectilinear section 1035 and 1065, by using the 1st, the 2nd bend section 1032, and 1034, 1062 and 1064 as the supporting point. That is, the 1st, the 2nd bend section 1032, the lower rectilinear sections 1031 and 1061 through 1034, 1062, and 1064, the method diagonal rectilinear sections 1033 and 1063 of slanting, and the upper rectilinear sections 1035 and 1065 act as a stress relaxation means. For this reason, even if the operating frequency of a clip 1000 becomes high, fatigue of an ingredient can be eased and a fatigue limit can be raised as a result. Since the pinching force over the piece of paper of a clip 1000 is not reduced by this even if the operating frequency of a clip 1000 becomes high, the use life of a clip 1000 can be raised.

Figure 11:
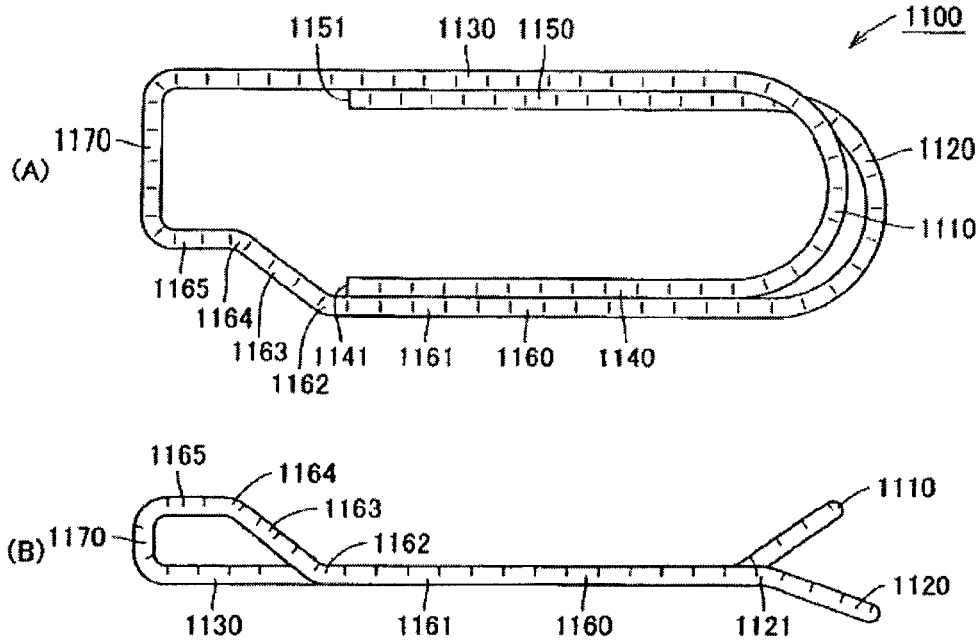
[FIG. 11] It is the top view (A) and front view (B) showing the embodiment of the 7th of the clip of this invention.

FIG. 11 is the top view (A) and front view (B) showing the embodiment of the 7th of the clip of this invention.

As shown in FIG. 11, a clip 1100 is a clip which consists of a wire material which has elasticity. The clip 1100 of this invention is equipped with the 1st bend section 1110, the 2nd bend section 1120, the 1st rectilinear section 1130 and the 2nd rectilinear section 1140, the 3rd rectilinear section 1150 and the 4th rectilinear section 1160, and the connection section 1170. The 2nd rectilinear section 1140 and the 3rd rectilinear section 1150 have the end edges 1141 and 1151, respectively.

Unlike the clip 1000 shown in FIG. 10, although the overall flat-surface configuration of a clip 1000 is a rectangle-like mostly, by the other side of a longitudinal direction, the connection section 1170 of the shape of a straight line of die length shorter than a rectangular shorter side is formed.

Moreover, in the clip 1100 of this invention, the 1st rectilinear section 1130 does not have bend section, and it is constituted so that it may extend in the shape of a straight line. On the other hand, the lower rectilinear section 1161 which the 4th rectilinear section 1160 has the 1st and the 2nd bend section 1162 and 1164, and was relatively positioned in the downward flat surface, The method diagonal rectilinear section 1163 of slanting which is bent through the 1st bend section 1162 and extended in the upper part from the lower rectilinear section 1161, and the upper rectilinear section 1165 after being bent through the 2nd bend section 1164 and being relatively positioned in an upper flat surface rather than a lower part flat surface succeeding the method diagonal rectilinear section 1163 of slanting are included. The connection section 1170 is following the upper rectilinear section 1165. In a clip 1100, furthermore, by bending the 1st rectilinear section 1130 and the 2nd rectilinear section 1140 up By bending the 3rd rectilinear section 1150 and the 4th rectilinear section 1160 caudad it is not only positioned in the upper location where the 1st bend section 1110 separated from the 2nd bend section 1120, but The 2nd bend section 1120 is positioned in the location of the lower part which is separated from the 1st bend section 1110, and the distance between the 1st bend section 1110 and the 2nd bend section 1120 is large.

The configuration of others of a clip 1100 is the same as the configuration of the clip 1000 shown in FIG. 10.

The clip 1100 shown in FIG. 11 does so the same operation effectiveness as the clip 1000 of FIG. 10.

Figure 13:
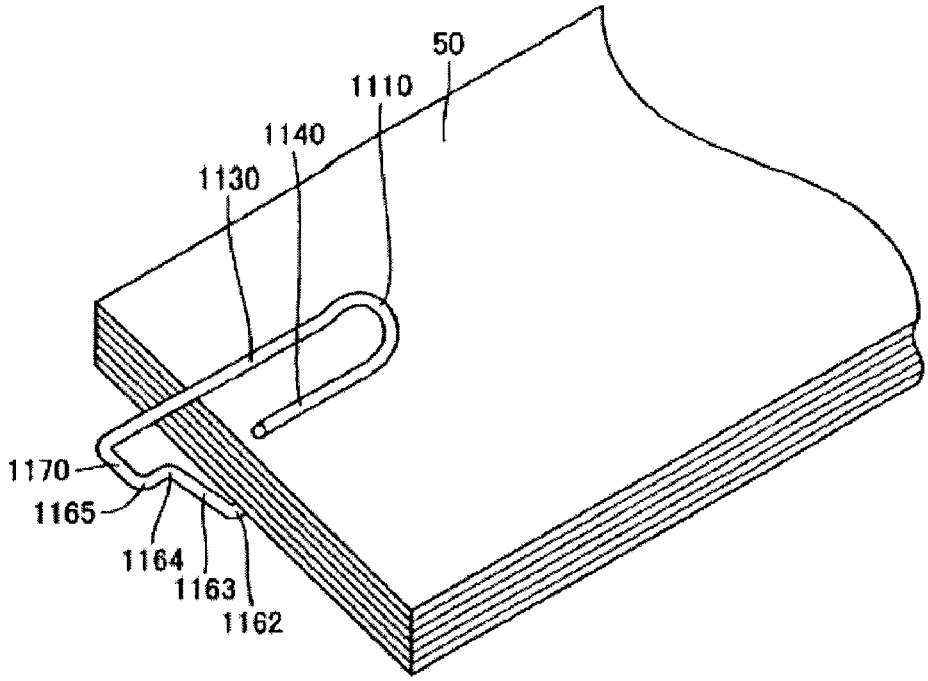
[FIG. 13] It is drawing showing the busy condition which put the piece of paper with the embodiment of the 7th of the clip of this invention.

FIG. 13 is a drawing showing the busy condition which put the piece of paper with the clip 1100 of this invention.

As shown in FIG. 13, when the thick piece of paper 50 which consists of two or more sheets with a clip 1100 is inserted, on both sides of two or more pieces of paper 50, it can fix by moving a clip 1100 along the front face of a piece of paper 50 until the method diagonal rectilinear section 1163 of slanting contacts the edge of a piece of paper 50. Thereby, the location of the method rectilinear section 1163 of slanting can adjust extent of the plug to the piece of paper 50 of a clip 1100. That is, the method diagonal rectilinear section 1163 of slanting can be used as a plug stopper to the piece of paper 50 of a clip 1100.

Moreover, the stress produced in the condition of having been crowded with the clip 1100 on both sides of the piece of paper 50 in this case can be distributed in the three directions, the lower rectilinear section 1061, the method diagonal rectilinear section 1163 of slanting, and the upper rectilinear section 1165, by using the 1st and the 2nd bend section 1162 and 1164 as the supporting point. That is, the 1st, the lower rectilinear section 1061 through the 2nd bend section 1162 and 1164, the method diagonal rectilinear section 1163 of slanting, and the upper rectilinear section 1165 act as a stress relaxation means. For this reason, even if the operating frequency of a clip 1100 becomes high, fatigue of an ingredient can be eased and a fatigue limit can be raised as a result. Since the pinching force over the piece of paper of a clip 1100 is not reduced by this even if the operating frequency of a clip 1100 becomes high, the use life of a clip 1100 can be raised.

Figure 12:
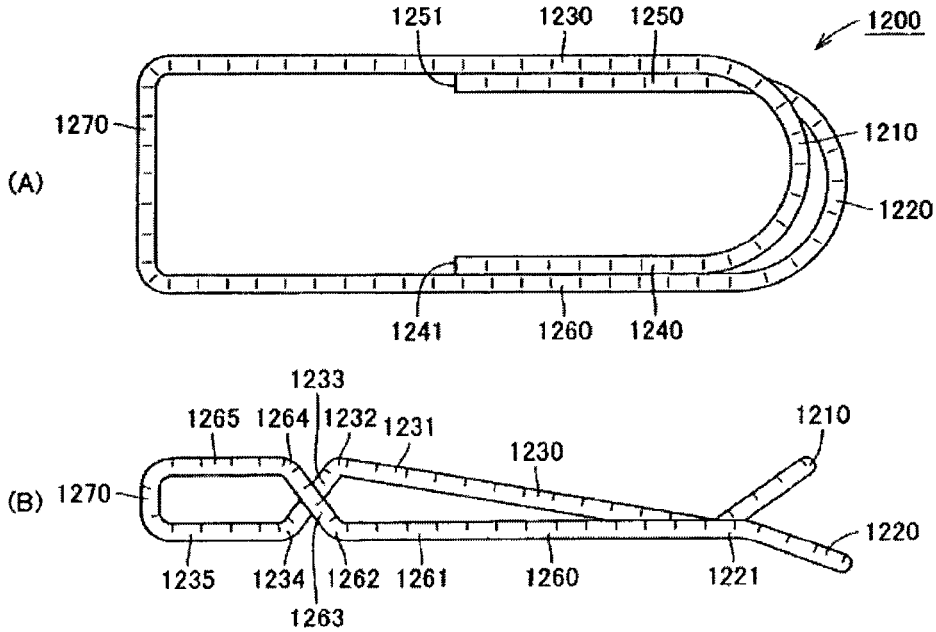
[FIG. 12] It is the top view (A) and front view (B) showing the embodiment of the 8th of the clip of this invention.

FIG. 12 is the top view (A) and front view (B) showing the embodiment of the 8th of the clip of this invention.

As shown in FIG. 12, a clip 1200 is a clip which consists of a wire material which has elasticity. The clip 1200 of this invention is equipped with the 1st bend section 1210, the 2nd bend section 1220, the 1st rectilinear section 1230 and the 2nd rectilinear section 1240, the 3rd rectilinear section 1250 and the 4th rectilinear section 1260, and the connection section 1270. The 2nd rectilinear section 1240 and the 3rd rectilinear section 1250 have the end edges 1241 and 1251, respectively.

Unlike the clip 1000 shown in FIG. 10, the overall flat-surface configuration of a clip 1200 is a rectangle-like mostly, but a rectangular shorter side is relatively long.

Moreover, it sets to the clip 1200 of this invention. The lower rectilinear section 1261 which the 4th rectilinear section 1260 has the 1st and the 2nd bend section 1262 and 1264, and was relatively positioned in the downward flat surface, The slant upper rectilinear section 1263 which is bent through the 1st bend section 1262 and extended in the upper part from the lower rectilinear section 1261, The upper rectilinear section 1265 after being bent through the 2nd bend section 1264 and being relatively positioned in an upper flat surface rather than a lower part flat surface succeeding the slant upper rectilinear section 1263 is included. Besides, the connection section 1270 is following the upper rectilinear section 1265.

The upper rectilinear section 1231 after the 1st rectilinear section 1230 has the 3rd and the 4th bend section 1232 and 1234 and being relatively positioned in an upper flat surface, The lower rectilinear section 1233 of slant which is bent through the 3rd bend section 1232 and is caudad extended from the upper rectilinear section 1231, The lower rectilinear section 1235 which was bent through the 4th bend section 1234 and was relatively positioned in the downward flat surface rather than the upper part flat surface succeeding the lower rectilinear section 1233 of slant is included. The connection section 1270 is following the lower [this] rectilinear section 1235.

In a clip 1200, furthermore, by bending the 1st rectilinear section 1230 and the 2nd rectilinear section 1240 up By bending the 3rd rectilinear section 1250 and the 4th rectilinear section 1260 caudad it is not only positioned in the upper location where the 1st bend section 1210 separated from the 2nd bend section 1220, but The 2nd bend section 1220 is positioned in the location of the lower part which is separated from the 1st bend section 1210, and the distance between the 1st bend section 1210 and the 2nd bend section 1220 is large.

The configuration of others of a clip 1200 is the same as the configuration of the clip 700 shown in FIG. 10.

The clip 1200 shown in FIG. 12 is added to the same operation effectiveness as the clip 1000 of FIG. 10, and does the following operation effectiveness so.

Figure 14:
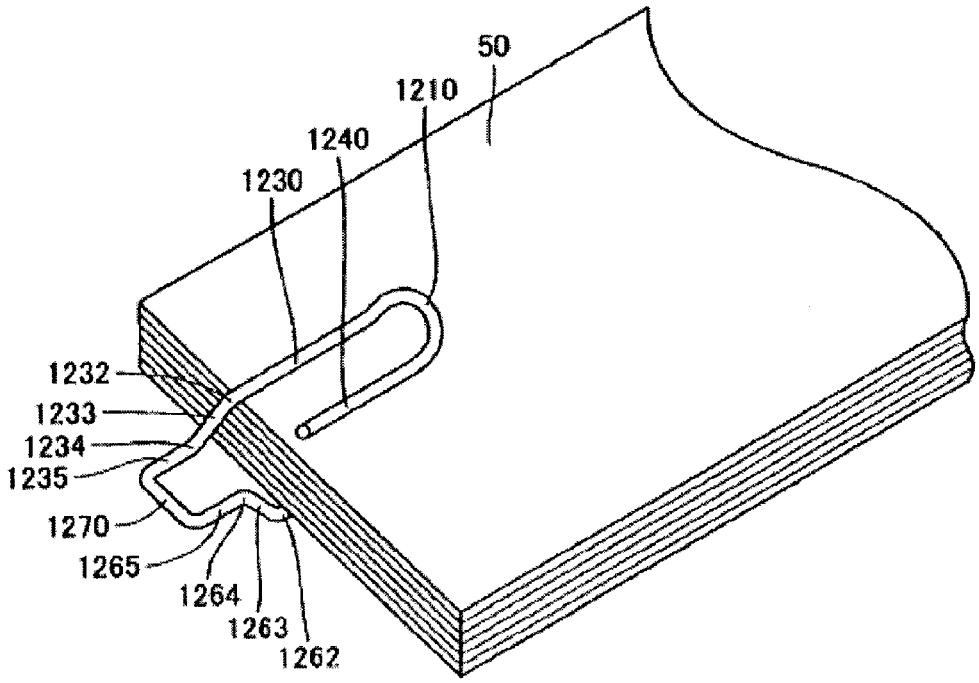
[FIG. 14] It is drawing showing the busy condition which put the piece of paper with the embodiment of the 8th of the clip of this invention.

FIG. 14 is a drawing showing the busy condition which put the piece of paper with the clip 1200 of this invention.

As shown in FIG. 14, when the thick piece of paper 50 which consists of two or more sheets with a clip 1200 is inserted, on both sides of two or more pieces of paper 50, it can fix by moving a clip 1200 along the front face of a piece of paper 50 until the slant upper rectilinear section 1263 and the lower rectilinear section 1233 of slant contact the edge of a piece of paper 50. Thereby, the location of the slant upper rectilinear section 1263 and the lower rectilinear section 1233 of slant can adjust extent of the plug to the piece of paper of a clip 1200. That is, the slant upper rectilinear section 1263 and the lower rectilinear section 1233 of slant can be used as a plug stopper to the piece of paper 50 of a clip 1200.

Moreover, the stress produced in the condition of having been crowded with the clip 1200 on both sides of the piece of paper 50 in this case The 1st and the 2nd bend section 1262 and 1264 are used as the supporting point. In the three directions, the lower rectilinear section 1261, the slant upper rectilinear section 1263, and the upper rectilinear section 1265 Moreover, it can be made to distribute in the three directions, the upper rectilinear section 1231, the lower rectilinear section 1233 of slant, and the lower rectilinear section 1235, by using the 3rd and the 4th bend section 1232 and 1234 as the supporting point. That is, each of the upper rectilinear section 1231 after minding the 1st, the lower rectilinear section 1261 through the 2nd bend section 1262 and 1264, the slant upper rectilinear section 1263, the upper rectilinear section 1265, and the 3rd and the 4th bend section 1232 and 1234, the lower rectilinear section 1233 of slant, and the lower rectilinear section 1235 acts as a stress relaxation means. For this reason, even if the operating frequency of a clip 1200 becomes high, fatigue of an ingredient can be eased and a fatigue limit can be raised more as a result. Since the pinching force over the piece of paper 50 of a clip 1200 is not reduced by this even if the operating frequency of a clip 1200 becomes high, the use life of a clip 1200 can be raised more.

Figure 15:
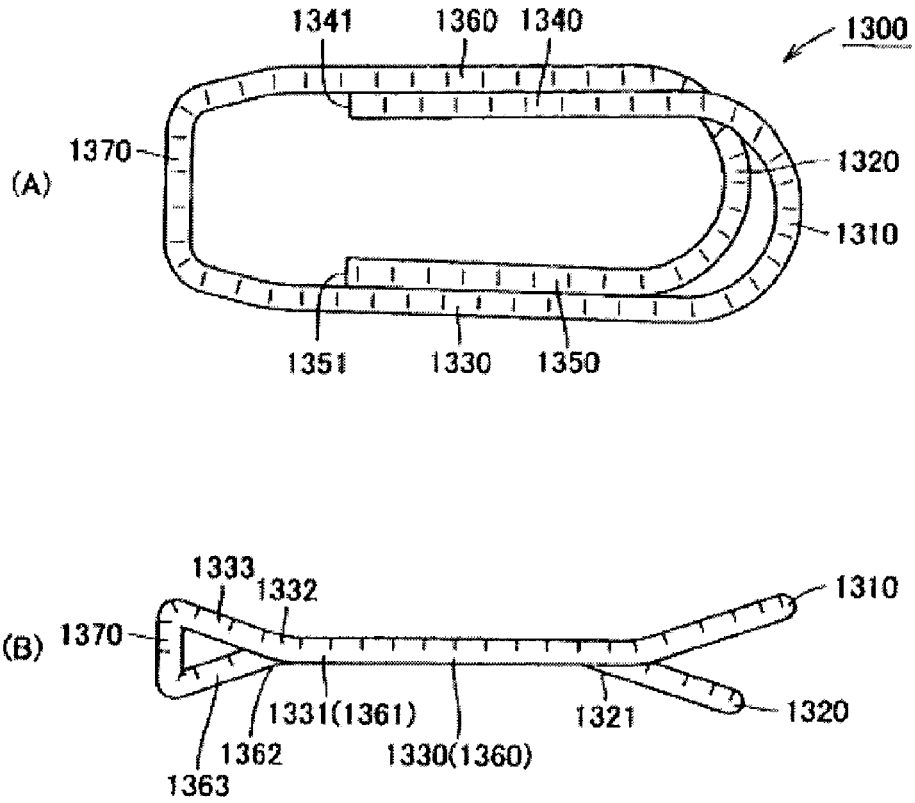
[FIG. 15] It is the top view (A) and front view (B) showing the embodiment of the 9th of the clip of this invention.
Figure 16:
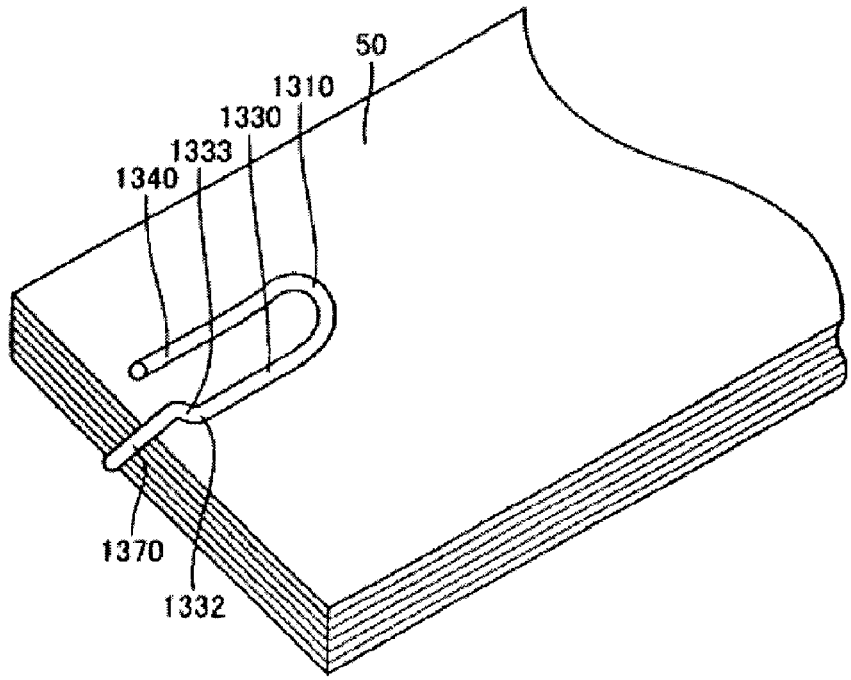
[FIG. 16] It is drawing showing the busy condition which put the piece of paper with the embodiment of the 9th of the clip of this invention.

The top view (A) in which FIG. 15 shows the embodiment of the 9th of the clip of this invention, a front view (B), and FIG. 16 is a drawing showing the busy condition which put the piece of paper with the embodiment of the 9th of the clip of this invention.

As shown in FIG. 15, a clip 1300 is a clip which consists of a wire material which has elasticity. The clip 1300 of this invention is equipped with the 1st bend section 1310, the 2nd bend section 1320, the 1st rectilinear section 1330 and the 2nd rectilinear section 1340, the 3rd rectilinear section 1350 and the 4th rectilinear section 1360, and the connection section 1370. The 2nd rectilinear section 1340 and the 3rd rectilinear section 1350 have the end edges 1341 and 1351, respectively.

Unlike the clip 1200 shown in FIG. 12, although it is a rectangle-like mostly, the overall flat-surface configuration of a clip 1300 is formed so that the die length of the connection section 1370 may become short relatively rather than a rectangular shorter side.

Moreover, in the clip 1300 of this invention, the 1st rectilinear section 1330 has the 1st bend section 1332, and contains the base rectilinear section 1331 and the slant upper rectilinear section 1333 which is bent through the 1st bend section 1332 and extended in the upper part from the base rectilinear section 1331. The connection section 1370 is following this slant upper rectilinear section 1333. The 4th rectilinear section 1360 has the 2nd bend section 1362, and contains the base rectilinear section 1361 and the lower rectilinear section 1363 of slant which is bent through the 2nd bend section 1362 and is caudad extended from the base rectilinear section 1361. The connection section 1370 is following this lower rectilinear section 1363 of slant.

The configuration of others of a clip 1300 is the same as the configuration of the clip 1200 shown in FIG. 12.

The clip 1300 shown in FIG. 15 is added to the same operation effectiveness as the clip 700 of FIG. 7, and does the following operation effectiveness so.

On both sides of two or more pieces of paper 50, it is fixable by moving a clip 1300 along the front face of a piece of paper 50 until the connection section 1370 contacts the edge of a piece of paper 50 through both the slant upper rectilinear section 1333 and the lower rectilinear section 1363 of slant when two or more thick pieces of paper 50 are inserted with a clip 1300 as shown in FIG. 15 and FIG. 16. Thereby, the connection section 1370 which follows both the slant upper rectilinear section 1333 and the lower rectilinear section 1363 of slant can be used as a plug stopper to the piece of paper 50 of a clip 1300.

Moreover, the stress produced in the condition of having been crowded with the clip 1300 on both sides of the piece of paper 50 in this case can be distributed in the two directions of the base rectilinear section 1331 and the slant upper rectilinear section 1333, and the two directions of each of the base rectilinear section 1361 and the lower rectilinear section 1363 of slant by using bend sections 1332 and 1362 as the supporting point. That is, the base rectilinear sections 1331 and 1361 through bend sections 1332 and 1362, the slant upper rectilinear section 1333, and the lower rectilinear section 1363 of slant act as a stress relaxation means. For this reason, even if the operating frequency of a clip 1300 becomes high, fatigue of an ingredient can be eased more and a fatigue limit can be raised as a result. Since the pinching force over the piece of paper 50 of a clip 1300 is not reduced by this even if the operating frequency of a clip 1300 becomes high, the use life of a clip 1300 can be raised more.

Furthermore, in the other side of a longitudinal direction, actuation which inserts and puts the edge of a piece of paper 50 between a clip 1300, or actuation which samples a clip 1300 from the edge of a piece of paper 50 can be easily performed by holding the slant upper rectilinear section 1333 which is following the connection section 1370, or the lower rectilinear section 1363 of slant.

Figure 17:
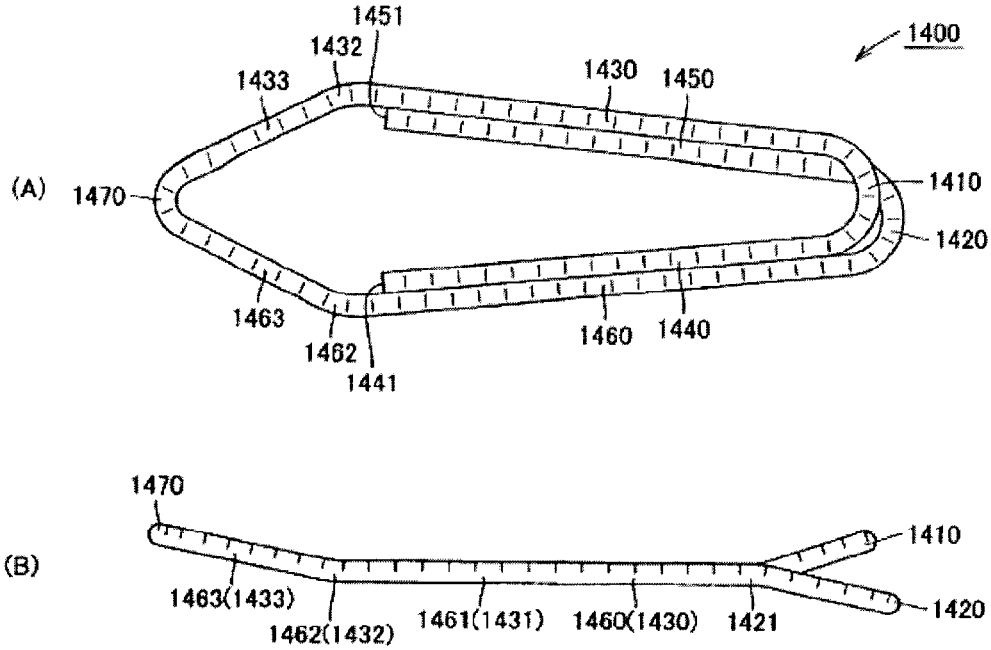
[FIG. 17] It is the top view (A) and front view (B) showing the embodiment of the 10th of the clip of this invention.

FIG. 17 is the top view (A) and front view (B) showing the embodiment of the 10th of the clip of this invention.

As shown in FIG. 17, a clip 1400 is a clip which consists of a wire material which has elasticity. The clip 1400 of this invention is equipped with the 1st bend section 1410, the 2nd bend section 1420, the 1st rectilinear section 1430 and the 2nd rectilinear section 1440, the 3rd rectilinear section 1450 and the 4th rectilinear section 1460, and the connection section 1470. The 1st rectilinear section 1430 and the 4th rectilinear section 1460 have the base rectilinear sections 1431 and 1461, bend sections 1432 and 1462, and the method diagonal rectilinear sections 1433 and 1463 of slanting, respectively. The 2nd rectilinear section 1440 and the 3rd rectilinear section 1450 have the end edges 1441 and 1451, respectively.

Unlike the clip 700 shown in FIG. 7, by the one side of a longitudinal direction, a wire material is relatively bent with small radius of curvature, the 1st bend section 1410 and the 2nd bend section 1420 are formed, a wire material is bent so that the method diagonal rectilinear sections 1433 and 1463 of slanting may approach mutually by bend sections 1432 and 1462 in the other side of a longitudinal direction, a wire material is bent with radius of curvature still smaller than one side, and, as for the overall flat-surface configuration of a clip 1400, the connection section 570 is formed.

In a clip 1400, moreover, by bending the 1st rectilinear section 1430 and the 2nd rectilinear section 1440 up By bending the 3rd rectilinear section 1450 and the 4th rectilinear section 1460 caudad it is not only positioned in the upper location where the 1st bend section 1410 separated from the 2nd bend section 1420, but The 2nd bend section 1420 is positioned in the location of the lower part which is separated from the 1st bend section 1410, and the distance between the 1st bend section 1410 and the 2nd bend section 1420 is large.

The configuration of others of a clip 1400 is the same as the configuration of the clip 700 shown in FIG. 7.

The clip 1400 shown in FIG. 17 has the same operation effectiveness as the clip 700 of FIG. 7.

Figure 18:
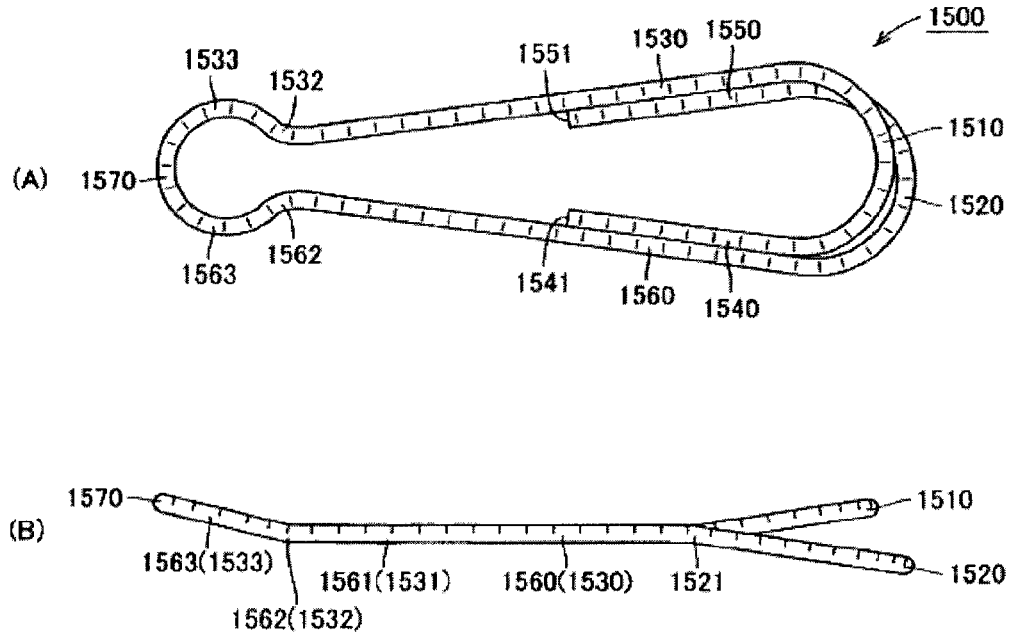
[FIG. 18] It is the top view (A) and front view (B) showing the embodiment of the 11th of the clip of this invention.

FIG. 18 is the top view (A) and front view (B) showing the embodiment of the 11th of the clip of this invention.

As shown in FIG. 18, a clip 1500 is a clip which consists of a wire material which has elasticity. The clip 1500 of this invention is equipped with the 1st bend section 1510, the 2nd bend section 1520, the 1st rectilinear section 1530 and the 2nd rectilinear section 1540, the 3rd rectilinear section 1550 and the 4th rectilinear section 1560, and the connection section 1570. The 1st rectilinear section 1530 and the 4th rectilinear section 1560 have the base rectilinear sections 1531 and 1561, bend sections 1532 and 1562, and the method diagonal rectilinear sections 1533 and 1563 of slanting, respectively. The 2nd rectilinear section 1540 and the 3rd rectilinear section 1550 have the end edges 1541 and 1551, respectively.

Unlike the clip 700 shown in FIG. 7, the overall flat-surface configuration of a clip 1500 is bent so that the 1st rectilinear section 1530 and the 4th rectilinear section 1560 may approach mutually as it goes to the other side from the one side of a longitudinal direction, and spacing may narrow, a wire material is bent with radius of curvature still smaller than one side by bend sections 1532 and 1562, and the connection section 570 is mostly formed in the other side at the circle configuration.

In a clip 1500, moreover, by bending the 1st rectilinear section 1530 and the 2nd rectilinear section 1540 up By bending the 3rd rectilinear section 1550 and the 4th rectilinear section 1560 caudad it is not only positioned in the upper location where the 1st bend section 1510 separated from the 2nd bend section 1520, but The 2nd bend section 1520 is positioned in the location of the lower part which is separated from the 1st bend section 1510, and the distance between the 1st bend section 1510 and the 2nd bend section 1420 is large.

The configuration of others of a clip 1500 is the same as the configuration of the clip 700 shown in FIG. 7.

The clip 1500 shown in FIG. 18 has the same operation effectiveness as the clip 700 of FIG. 7.

Figure 19:
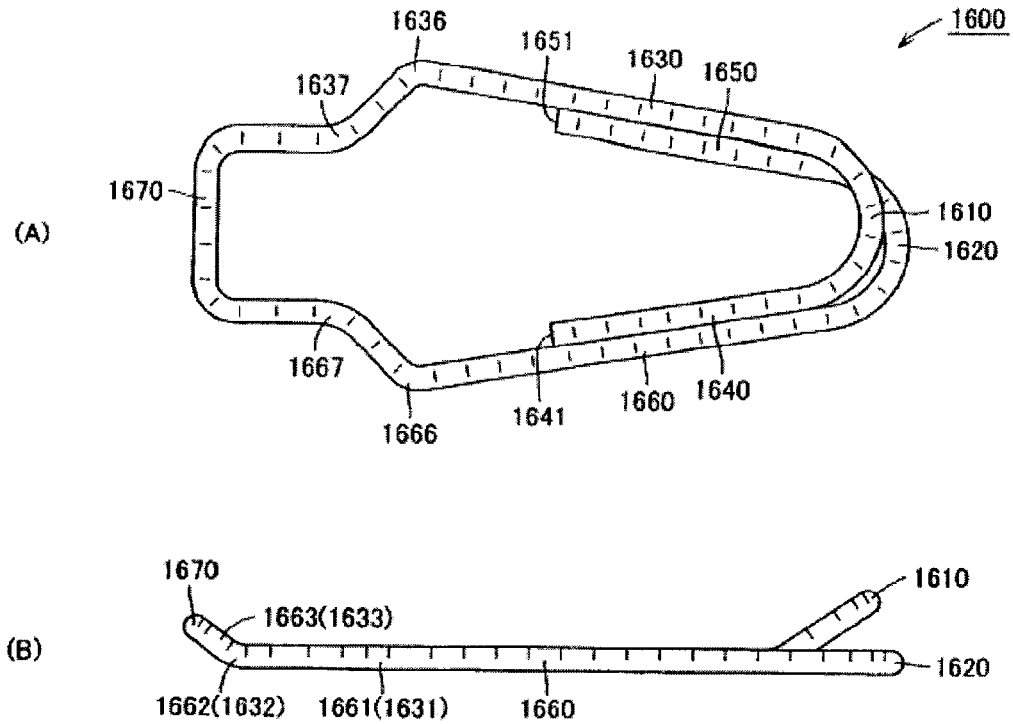
[FIG. 19] It is the top view (A) and front view (B) showing the embodiment of the 12th of the clip of this invention.

FIG. 19 is the top view (A) and front view (B) showing the embodiment of the 12th of the clip of this invention.

As shown in FIG. 19, a clip 1600 is a clip which consists of a wire material which has elasticity. The clip 1600 of this invention is equipped with the 1st bend section 1610, the 2nd bend section 1620, the 1st rectilinear section 1630 and the 2nd rectilinear section 1640, the 3rd rectilinear section 1650 and the 4th rectilinear section 1660, and the connection section 1670. The 1st rectilinear section 1630 and the 4th rectilinear section 1660 have the base rectilinear sections 1631 and 1661, bend sections 1632 and 1662, and the method diagonal rectilinear sections 1633 and 1663 of slanting, respectively. The 2nd rectilinear section 1640 and the 3rd rectilinear section 1650 have the end edges 1641 and 1651, respectively.

Unlike the clip 700 shown in FIG. 7, the overall flat-surface configuration of a clip 1600 is bent so that the 1st rectilinear section 1630 and the 4th rectilinear section 1660 may be isolated toward the other side from the one side of a longitudinal direction, it is bent so that it may approach mutually by bend sections 1636 and 1666, and it is formed so that it may extend at the almost same spacing, until it results [from bend sections 1637 and 1667] in the connection section 1670 further. The connection section 570 is mostly formed in the shape of a straight line.

Moreover, in the clip 1600, the 1st bend section 1610 is positioned in the upper location distant from the 2nd bend section 1620 by bending the 1st rectilinear section 1630 and the 2nd rectilinear section 1640 up.

The configuration of others of a clip 1600 is the same as the configuration of the clip 700 shown in FIG. 7.

The clip 1600 shown in FIG. 19 has the same operation effectiveness as the clip 700 of FIG. 7.

The clip of the flat-surface configuration shown in FIG. 17, FIG. 18, and FIG. 19 can be used in order to pinch cloth etc. as the clip for an ornament, a simple tiepin, etc., and the flat-surface configuration of a clip can deform into various configurations according to a design, without being limited to what is shown in these drawings.

Figure 20:
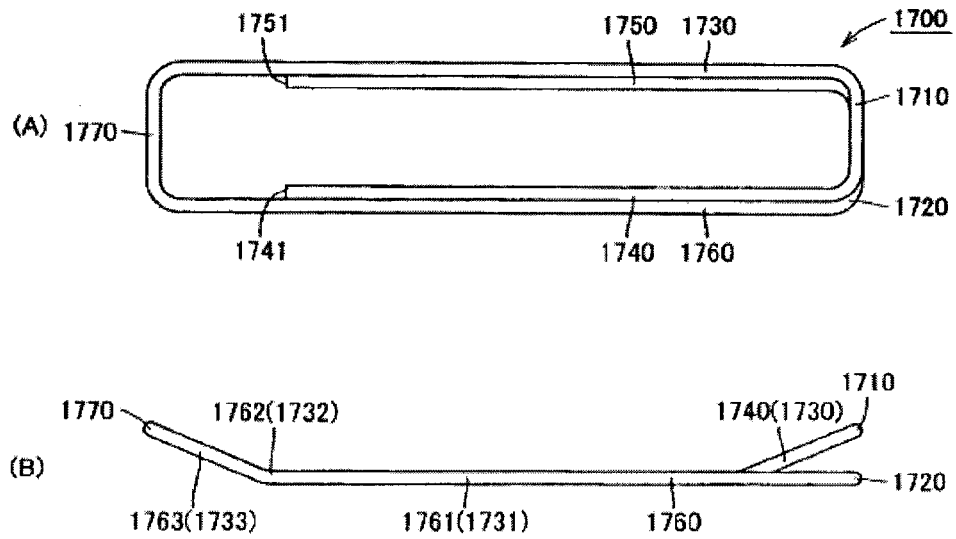
[FIG. 20] It is the top view (A) and front view (B) showing the embodiment of the 13th of the clip of this invention.
Figure 21:
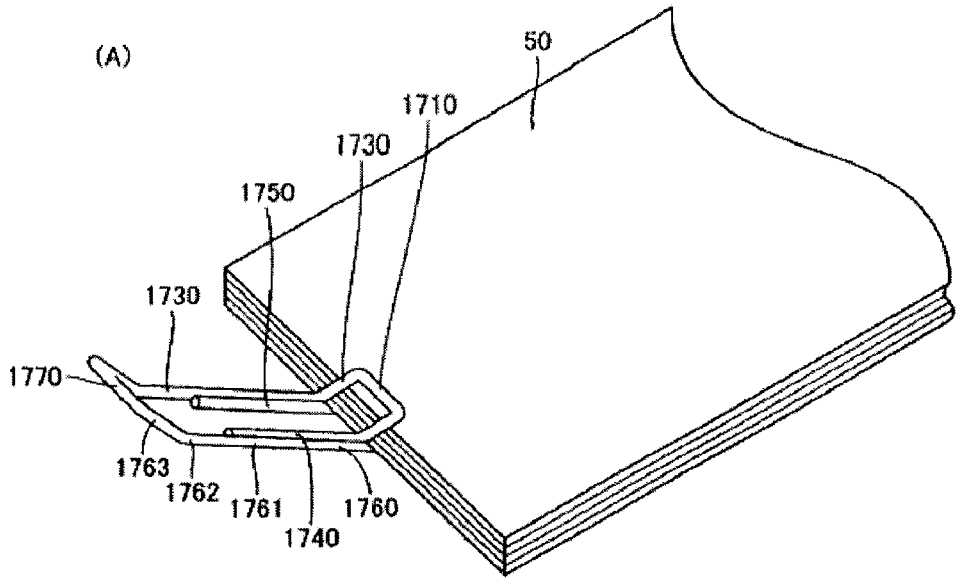
[FIG. 21] They are drawing (A) showing the busy condition after putting before putting a piece of paper with the embodiment of the 13th of the clip of this invention, and (B).
Figure 21:
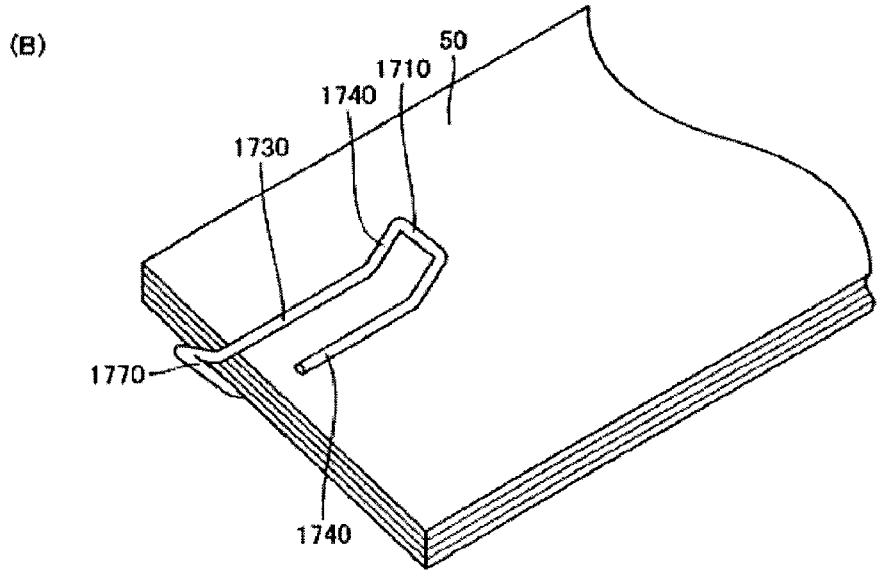

The top view (A) in which FIG. 20 shows the embodiment of the 13th of the clip of this invention, a front view (B), and FIG. 21 is a drawing (A) showing the busy condition after putting before putting a piece of paper with the embodiment of the 13th of the clip of this invention, and (B).

As shown in FIG. 20, a clip 1700 is a clip which consists of a wire material which has elasticity. The clip 1700 of this invention is equipped with the 1st bend section 1710, the 2nd bend section 1720, the 1st rectilinear section 1730 and the 2nd rectilinear section 1740, the 3rd rectilinear section 1750 and the 4th rectilinear section 1760, and the connection section 1770. The 1st rectilinear section 1730 and the 4th rectilinear section 1760 have the base rectilinear sections 1731 and 1761, bend sections 1732 and 1762, and the method diagonal rectilinear sections 1733 and 1763 of slanting, respectively. The 2nd rectilinear section 1740 and the 3rd rectilinear section 1750 have the end edges 1741 and 1751, respectively.

Unlike the clip 100 shown in FIG. 1, the flat-surface configuration of the 1st bend section 1710, the 2nd bend section 1720, and the connection section 1770 is a straight line-like mostly.

The configuration of others of a clip 1700 is the same as the configuration of the clip 100 shown in FIG. 1.

The clip 1700 shown in FIG. 20 is added to the same operation effectiveness as the clip 100 of FIG. 1, and does the following operation effectiveness so.

Since the 1st bend section 1710 and the 2nd bend section 1720 which are arranged at the one side of a longitudinal direction are formed in the shape of a straight line as shown in FIG. 21 (A) After contacting the 1st bend section 1710 on the front face of a piece of paper 50, the straight-line-like 1st bend section 1710 can be mostly made a guide, a piece of paper 50 can be inserted between the 1st bend section 1710 and the 2nd bend section 1720, and as shown in FIG. 21 (B), a piece of paper 50 can be put with a clip 1700. Thereby, a piece of paper 50 can be inserted in a clip 1700, and actuation to put can be performed more easily.

Figure 22:
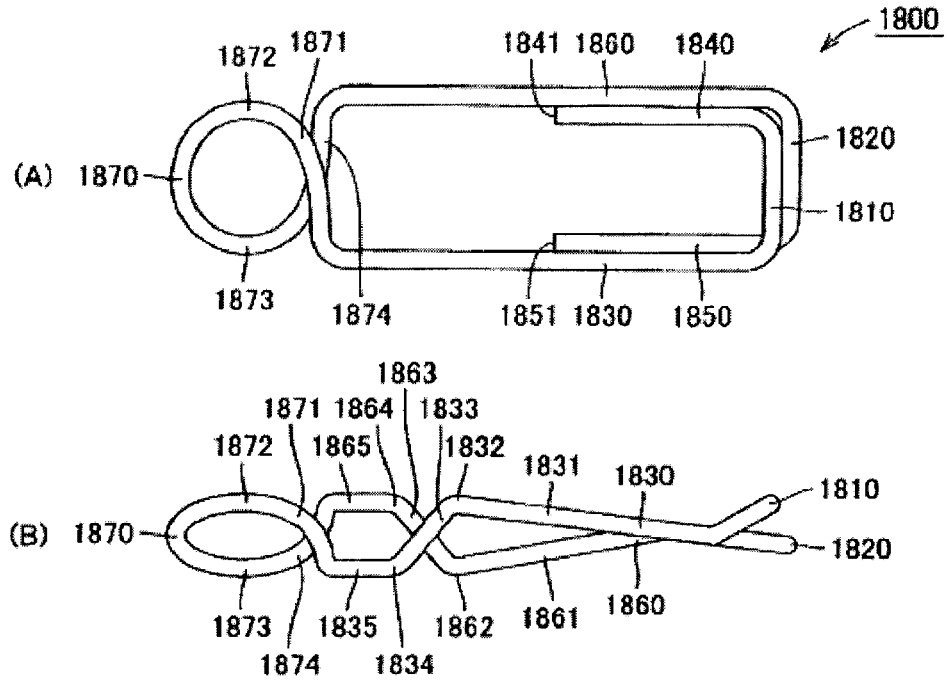
[FIG. 22] It is the top view (A) and front view (B) showing the embodiment of the 14th of the clip of this invention.

FIG. 22 is the top view (A) and front view (B) showing the embodiment of the 14th of the clip of this invention.

As shown in FIG. 22, a clip 1800 is a clip which consists of a wire material which has elasticity. The clip 1800 of this invention is equipped with the 1st bend section 1810, the 2nd bend section 1820, the 1st rectilinear section 1830 and the 2nd rectilinear section 1840, the 3rd rectilinear section 1850 and the 4th rectilinear section 1860, and the connection section 1870. The 2nd rectilinear section 1840 and the 3rd rectilinear section 1850 have the end edges 1841 and 1851, respectively.

Unlike the clip 1200 shown in FIG. 12, although the overall flat-surface configuration of a clip 1800 is a rectangle-like mostly, in the one side of a longitudinal direction, the 1st bend section 1810 and the 2nd bend section 1820 are straight lines-like mostly, and the connection section 1870 has the annular section of a circle configuration mostly by the other side of a longitudinal direction.

In the clip 1800 of this invention the 4th rectilinear section 1860 The lower rectilinear section 1861 which has the 1st and the 2nd bend section 1862 and 1864, and was relatively positioned in the downward flat surface, The slant upper rectilinear section 1863 which is bent through the 1st bend section 1862 and extended in the upper part from the lower rectilinear section 1861, The upper rectilinear section 1865 after being bent through the 2nd bend section 1864 and being relatively positioned in an upper flat surface rather than a lower part flat surface succeeding the slant upper rectilinear section 1863 is included. Besides, the connection section 1870 is following the upper rectilinear section 1865.

The upper rectilinear section 1831 after the 1st rectilinear section 1830 has the 3rd and the 4th bend section 1832 and 1834 and being relatively positioned in an upper flat surface, The lower rectilinear section 1833 of slant which is bent through the 3rd bend section 1832 and is caudad extended from the upper rectilinear section 1831, The lower rectilinear section 1835 which was bent through the 4th bend section 1834 and was relatively positioned in the downward flat surface rather than the upper part flat surface succeeding the lower rectilinear section 1833 of slant is included. The connection section 1870 is following the lower [this] rectilinear section 1835.

In this case, the connection section 1870 has the annular section which consists of the upper part revolution sections 1871 and 1872 which follow the lower rectilinear section 1835 of the 1st rectilinear section 1830, and circle up relatively, and the lower part revolution sections 1873 and 1874 which follow the 4th rectilinear section 1860 upper rectilinear section 1865 after circling caudad relatively succeeding this upper part revolution section 1872.

The configuration of others of a clip 1800 is the same as the configuration of the clip 1200 shown in FIG. 12.

The clip 1800 shown in FIG. 22 is added to the same operation effectiveness as the clip 1200 of FIG. 12, and does the following operation effectiveness so.

Figure 24:
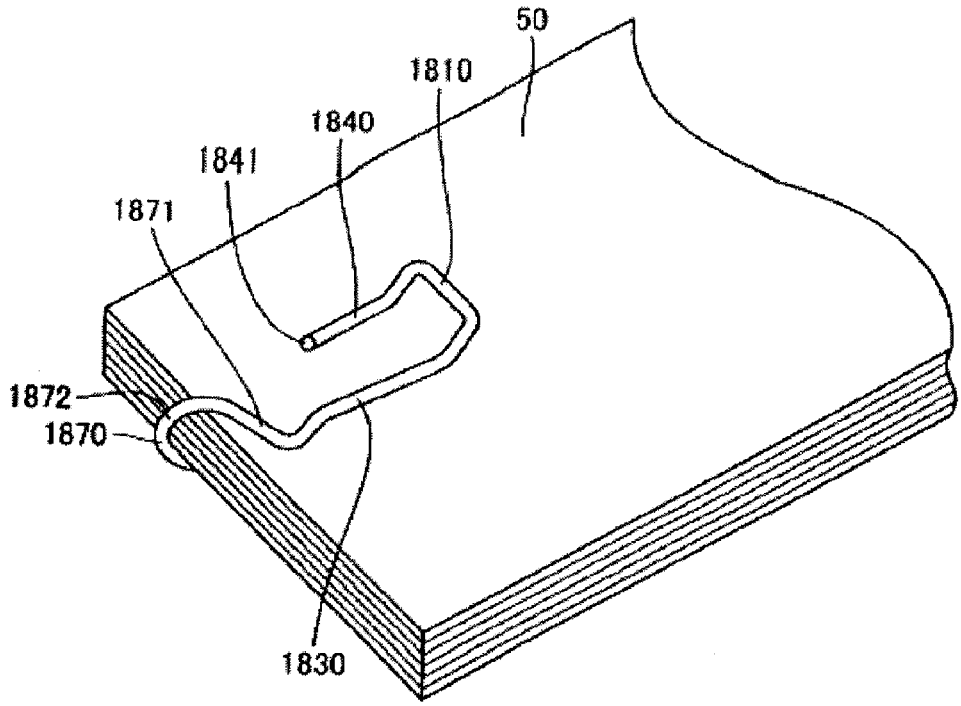
[FIG. 24] It is drawing showing the busy condition which put the piece of paper with the embodiment of the 14th of the clip of this invention.

FIG. 24 is a drawing showing the busy condition which put the piece of paper with the clip 1800 of this invention.

As shown in FIG. 22 and FIG. 24, the 1st and the 2nd bend section 1862 and 1864. Each of the upward turning part 1831 after minding the minded lower rectilinear section 1861, the slant upper rectilinear section 1863, the upper rectilinear section 1865, and the 3rd and the 4th bend section 1832 and 1834, the lower rectilinear section 1833 of slant, and the lower rectilinear section 1834 not only acts as a stress relaxation means, but The annular section which consists of the upper part revolution sections 1871 and 1872 which constitute the connection section 1870, and the lower part revolution sections 1873 and 1874 also acts as a stress relaxation means. For this reason, even if the operating frequency of a clip 1800 becomes high, fatigue of an ingredient can be eased further and a fatigue limit can be raised more as a result. Since the pinching force over the piece of paper of a clip 1800 is not reduced by this even if the operating frequency of a clip 1800 becomes high, the use life of a clip 1800 can be raised further.

Moreover, on both sides of two or more pieces of paper 50, it is fixable by moving a clip 1800 along the front face of a piece of paper 50 until the edge of the annular section which constitutes the connection section 1870 contacts the edge of a piece of paper 50 when a piece of paper 50 is inserted with a clip 1800 as shown in FIG. 24 in this case. Thereby, the annular section which constitutes the connection section 1870 can be used as a plug stopper to the piece of paper 50 of a clip 1800.

Figure 23:
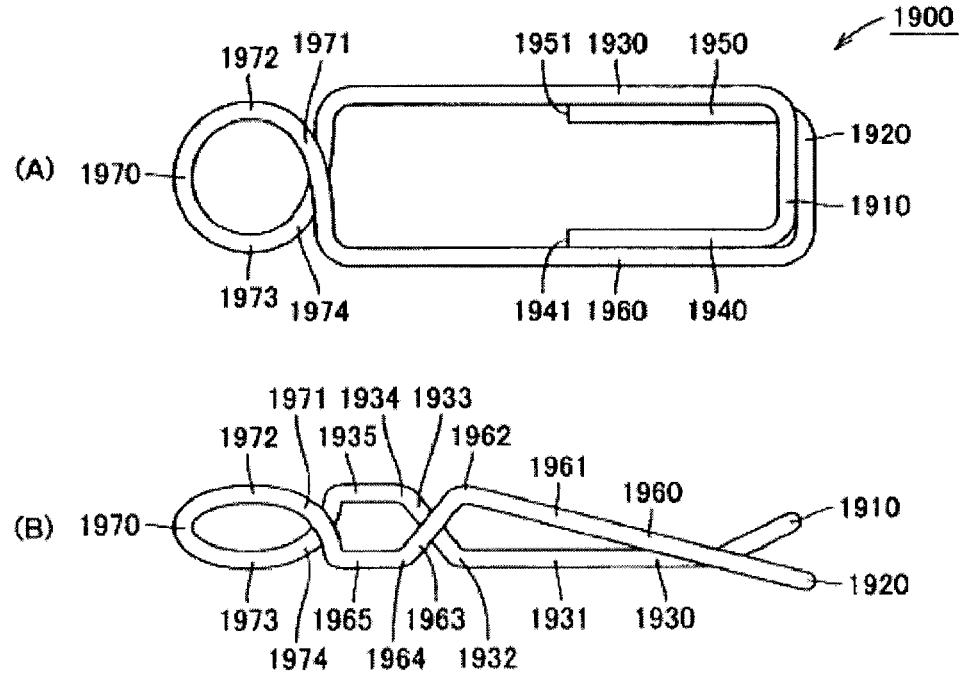
[FIG. 23] It is the top view (A) and front view (B) showing the embodiment of the 15th of the clip of this invention.

FIG. 23 is the top view (A) and front view (B) showing the embodiment of the 15th of the clip of this invention.

As shown in FIG. 23, a clip 1900 is a clip which consists of a wire material which has elasticity. The clip 1900 of this invention is equipped with the 1st bend section 1910, the 2nd bend section 1920, the 1st rectilinear section 1930 and the 2nd rectilinear section 1940, the 3rd rectilinear section 1950 and the 4th rectilinear section 1960, and the connection section 1970. The 2nd rectilinear section 1940 and the 3rd rectilinear section 1950 have the end edges 1941 and 1951, respectively.

Unlike the clip 1200 shown in FIG. 12, although the overall flat-surface configuration of a clip 1900 is a rectangle-like mostly, in the one side of a longitudinal direction, the 1st bend section 1910 and the 2nd bend section 1920 are straight lines-like mostly, and the connection section 1970 has the annular section of a circle configuration mostly by the other side of a longitudinal direction.

In the clip 1900 of this invention the 1st rectilinear section 1930 The lower rectilinear section 1931 which has the 1st and the 2nd bend section 1932 and 1934, and was relatively positioned in the downward flat surface, The slant upper rectilinear section 1933 which is bent through the 1st bend section 1932 and extended in the upper part from the lower rectilinear section 1931, The upper rectilinear section 1935 after being bent through the 2nd bend section 1934 and being relatively positioned in an upper flat surface rather than a lower part flat surface succeeding the slant upper rectilinear section 1933 is included. Besides, the connection section 1970 is following the upper rectilinear section 1935.

The upper rectilinear section 1961 after the 4th rectilinear section 1960 has the 3rd and the 4th bend section 1962 and 1964 and being relatively positioned in an upper flat surface, The lower rectilinear section 1963 of slant which is bent through the 3rd bend section 1962 and is caudad extended from the upper rectilinear section 1961, The lower rectilinear section 1965 which was bent through the 4th bend section 1964 and was relatively positioned in the downward flat surface rather than the upper part flat surface succeeding the lower rectilinear section 1963 of slant is included. The connection section 1970 is following the lower [this] rectilinear section 1965.

In this case, the connection section 1970 has the annular section which consists of the upper part revolution sections 1971 and 1972 which follow the lower rectilinear section 1965 of the 4th rectilinear section 1960, and circle up relatively, and the lower part revolution sections 1973 and 1974 which follow the 1st rectilinear section 1930 upper rectilinear section 1935 after circling caudad relatively succeeding this upper part revolution section 1972.

The configuration of others of a clip 1900 is the same as the configuration of the clip 1200 shown in FIG. 12.

The clip 1900 shown in FIG. 23 is added to the same operation effectiveness as the clip 1200 of FIG. 12, and does the following operation effectiveness so.

Figure 25:
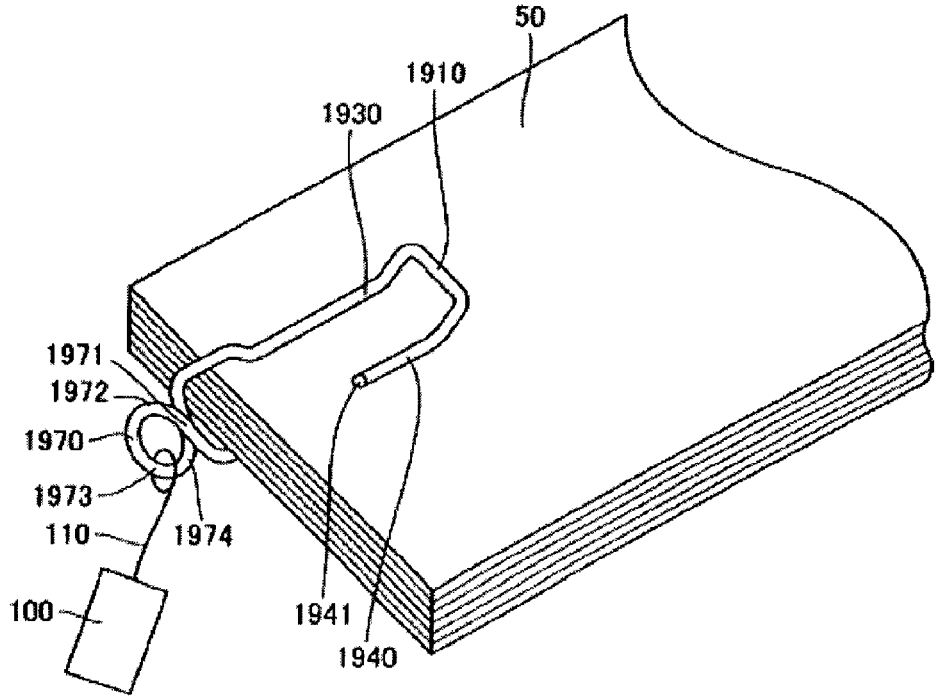
[FIG. 25] It is drawing showing the busy condition which put the piece of paper with the embodiment of the 15th of the clip of this invention.

FIG. 25 is a drawing showing the busy condition which put the piece of paper with the clip 1900 of this invention.

On both sides of two or more pieces of paper 50, it is fixable by moving a clip 1900 along the front face of a piece of paper 50 until the part where the upper part revolution sections 1971 and 1972 which constitute the connection section 1970, and the lower part revolution sections 1973 and 1974 crossed contacts the edge of a piece of paper 50 when a piece of paper 50 is inserted with a clip 1900 as shown in FIG. 25. Thereby, the part where the above crossed can be used as a plug stopper to the piece of paper of a clip 1900.

Moreover, the part where the upper part revolution sections 1971 and 1972 which constitute the connection section 1970 from a clip 1900 in the condition of having inserted the piece of paper 50, and the lower part revolution sections 1973 and 1974 crossed contacts the edge of a piece of paper 50 in this case, and the annular section is in the location projected from the edge of a piece of paper 50. For this reason, a paper label 100 with tag or wire 110 can be hooked on the annular section in this projected location. In addition, in order to enable it to hook a paper label 100 with tag or wire 110, the annular section of a circle configuration may be formed mostly, it replaces with the annular section which consists of the upper part revolution sections 1971 and 1972 and the lower part revolution sections 1973 and 1974, and consists of the revolution section mostly positioned on the same flat surface, may form the approximately circular annulus of the form shown in the connection section 1570 formed by the other side of the longitudinal direction of the clip 1500 shown in FIG. 18.

Figure 26:
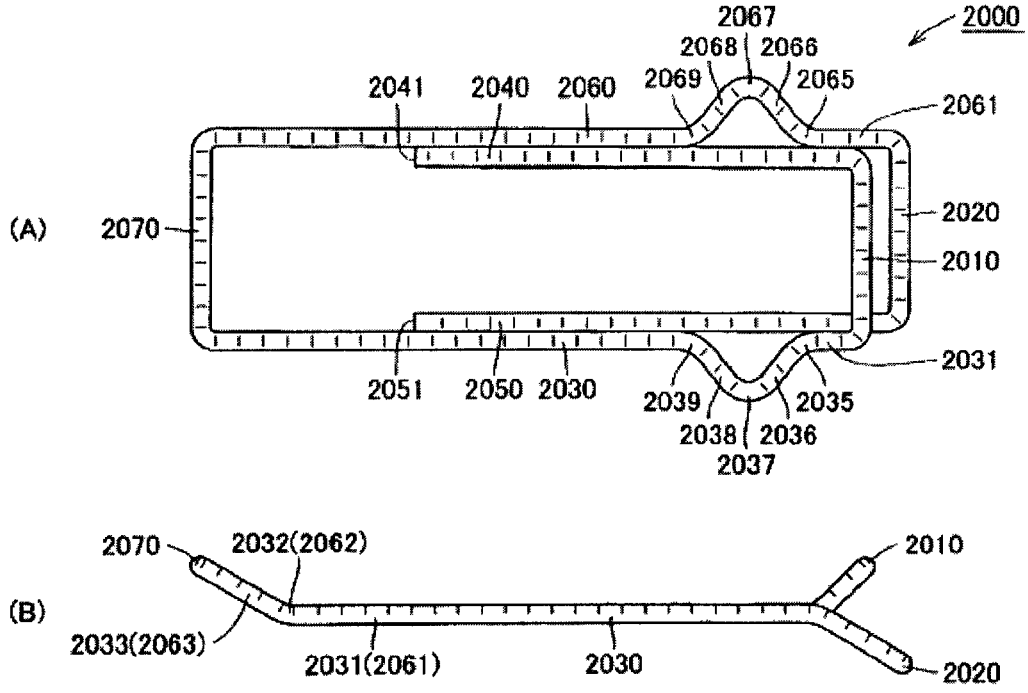
[FIG. 26] It is the top view (A) and front view (B) showing the embodiment of the 16th of the clip of this invention.

FIG. 26 is the top view (A) and front view (B) showing the embodiment of the 16th of the clip of this invention.

As shown in FIG. 26, a clip 2000 is a clip which consists of a wire material which has elasticity. The clip 2000 of this invention is equipped with the 1st bend section 2010, the 2nd bend section 2020, the 1st rectilinear section 2030 and the 2nd rectilinear section 2040, the 3rd rectilinear section 2050 and the 4th rectilinear section 2060, and the connection section 2070. The 1st rectilinear section 2030 and the 4th rectilinear section 2060 have the base rectilinear sections 2031 and 2061, bend sections 2032 and 2062, and the method diagonal rectilinear sections 2033 and 2063 of slanting, respectively. The 2nd rectilinear section 2040 and the 3rd rectilinear section 2050 have the end edges 2041 and 2051, respectively.

Unlike the clip 1700 shown in FIG. 20, the 1st rectilinear section 2030 has bend sections 2035, 2037, and 2039 in the one side of a longitudinal direction, i.e., the side near the 1st bend section 2010, and the 4th rectilinear section 2060 has bend sections 2065, 2067, and 2069 in the one side of a longitudinal direction, i.e., the side near the 2nd bend section 2020.

The 1st rectilinear section 2030 has the method diagonal rectilinear section 2036 of slanting which is bent through bend section 2035 and extended toward the outside of a clip from the base rectilinear section 2031, and the method diagonal rectilinear section 2038 of slanting which is bent to hard flow through the bend section 2037 located in the outermost part of a clip, and is extended toward the inside of a clip, and the method diagonal rectilinear section 2038 of slanting and the base rectilinear section 2031 are connected through the bend section 2039. The 4th rectilinear section 2060 has the method diagonal rectilinear section 2066 of slanting which is bent through bend section 2065 and extended toward the outside of a clip from the base rectilinear section 2061, and the method diagonal rectilinear section 2068 of slanting which is bent to hard flow through the bend section 2067 located in the outermost part of a clip, and is extended toward the inside of a clip, and the method diagonal rectilinear section 2068 of slanting and the base rectilinear section 2061 are connected through the bend section 2069.

Through these bend sections, the 1st rectilinear section 2030 and the 4th rectilinear section 2060 may be bent almost horizontally on the same flat surface, and may be bent by a perpendicular direction, i.e., the upper part, or the lower part.

In a clip 2000, moreover, by bending the 1st rectilinear section 2030 and the 2nd rectilinear section 2040 up By bending the 3rd rectilinear section 2050 and the 4th rectilinear section 2060 caudad it is not only positioned in the upper location where the 1st bend section 2010 separated from the 2nd bend section 2020, but The 2nd bend section 2020 is positioned in the location of the lower part which is separated from the 1st bend section 2010, and the distance between the 1st bend section 2010 and the 2nd bend section 2020 is large.

The configuration of others of a clip 2000 is the same as the configuration of the clip 1700 shown in FIG. 20.

The clip 2000 shown in FIG. 26 is added to the same operation effectiveness as the clip 1700 of FIG. 17, and does the following operation effectiveness so.

Work hardening can be brought to a wire material by forming the various bend sections 2035, 2037, and 2039 in the 1st rectilinear section 2030 located in the 1st bend section 2010 side, and forming the various bend sections 2065, 2067, and 2069 in the 4th rectilinear section 2060 located in the 2nd bend section 2020 side. For this reason, when a piece of paper is put by the 1st bend section 2010 and the 2nd bend section 2020, the bigger clip force than the conventional clip can be generated. Thereby, the pinching force over the piece of paper of a clip etc. can be heightened. It is made the configuration which turned at the 1st rectilinear section 2030 which in other words is located in the side near the 1st bend section 2010 by forming two or more bend sections at least to concave convex, and if the 4th rectilinear section 2060 located in the side near the 2nd bend section 2020 by forming two or more bend sections at least is made into the configuration at which it turned to concave convex, the above-mentioned operation effectiveness can be attained.

In addition, the clip of the embodiment of various operations of this invention mentioned above is not only formed from the wire material which has the elasticity of the wire made from a metal and an alloy etc., but may be formed from the wire material which has the elasticity made of synthetic resin.

In the clip of the embodiment of various operations of this invention mentioned above moreover, each of the 1st rectilinear section and the 4th rectilinear section While being bent by the upper part and/or the lower part in the other side of a longitudinal direction, i.e., the side near the connection section, through bend section It may be constituted so that it may extend outside, and it may be constituted so that the die length of the connection section may become larger than spacing of the 1st rectilinear section and the 4th rectilinear section, so that spacing of the 1st rectilinear section and the 4th rectilinear section may spread. In this case, a thicker piece of paper can be inserted with a clip.

Furthermore, with the clip of the embodiment of various operations of this invention mentioned above, each of the 1st rectilinear section and the 4th rectilinear section may be made into the upper part and/or the configuration at which it turned to concave convex horizontally through the bend section although bent caudad in the other side of a longitudinal direction, i.e., the side near the connection section, through bend section, and may be horizontally bent in the shape of zigzag. In this case, although a thicker piece of paper is repeated and put with a clip, since the pinching force over the piece of paper of a clip cannot be reduced and fatigue of an ingredient can be eased, the use life of a clip can be raised.

In clips according to various embodiments of the invention, which are described above, these are illustrated so that the boundaries between various rectilinear sections and bend sections are made clear. However, they may be produced so that various rectilinear sections and bent sections are smoothly continued to each other.

It is considered that the embodiments disclosed above are only examples in all of the aspects and are not limited in any way. The scope of the present invention is not limited by the embodiments described above but is described by the scope of claims, and may include various modifications and variations in equivalent meaning and the scope of Claims.

INDUSTRIAL APPLICABILITY

The clip of this invention can be made small-sized, can minimize the quantity of wire materials necessary to produce a clip of a predetermined size, can increase its nipping or holding force for sheets and cloth, and can be easily used by a visually-impaired person and a presbyopic person.

The invention claimed is:

1. A clip (100) composed of a wire having resiliency, comprising: first and second bend sections (110, 120) which are located at one side in the longitudinal direction, are formed of a wire material and are bent to be almost U-shaped; first and second rectilinear sections (130, 140) formed so that the wire material extends almost rectilinearly with a spacing from both ends of the first bend section (110) toward the other side in the longitudinal direction; third and fourth rectilinear sections (150, 160) formed so that the wire material almost rectilinearly extends with a spacing from both ends of the second bend section (120) toward the other side in the longitudinal direction; and a connection section (170) that connects the first rectilinear section (130) and the fourth rectilinear section (160) together at the other side in the longitudinal direction and extends so as to cross over the spacing between the first rectilinear section (130) and the fourth rectilinear section (160); wherein the first rectilinear section (130) is extended and held in contact with the third rectilinear section (150) from the first bend section (110) to the connection section (170), and the fourth rectilinear section (160) is extended and held in contact with the second rectilinear section (140) from the second bend section (120) to the connection section (170), the second rectilinear section (140) and the third rectilinear section (150) have wire end edges (141 and 151) at the other end side in the longitudinal direction thereof, the end edges (141, 151) of the second rectilinear section (140) and the third rectilinear section (150) are positioned within a region surrounded by the first rectilinear section (130), the fourth rectilinear section (160) and the connection section (170) by the first bend section (110) or the first rectilinear section (130) extending on or crossing the second bend section (120) or the third rectilinear section (150), the first bend section (110) is located almost at the same position as that of the second bend section (120) in the longitudinal direction or is located and held in proximity with the second bend section (120) with a spacing less than the diameter of the wire material, the first bend section (110) is located at a position upwardly apart from the second bend section (120) by the first rectilinear section (130) and the second rectilinear section (140) being bent upward, the first rectilinear section (130) and the third rectilinear section (150) are extended in parallel and held in contact with each other, and the second rectilinear section (140) and the fourth rectilinear section (160) are extended and held in contact with each other.

2. The clip (1100) according to claim 1, wherein at least either one of the first rectilinear section (1130) or the fourth rectilinear section (1160) includes a bent section (1162), a base rectilinear section (1161) or a diagonal rectilinear section (1163) that is bent via the bent section (1162) and extends upward from the base rectilinear section (1161), and the connection section (1170) is connected to the diagonal rectilinear section (1163).

3. The clip (1100) according to claim 1, wherein at least either one of the first rectilinear section (1130) or the fourth rectilinear section (1160) includes first and second bent sections (1162, 1164), a downward rectilinear section (1161) located at a relatively downward plane, a diagonal rectilinear section (1163) that is bent via the first bent section (1162) and extends upward from the downward rectilinear section (1161), and an upper rectilinear section (1165) that is bent via the second bent section (1164), is continued to the diagonal rectilinear section (1163) and is located at a plane relatively further upward than the downward plane, and the connection section (1170) is connected to the upward rectilinear section (1165).

4. The clip (1800) according to claim 3, wherein the connection section (1870) includes an annular section consisting of upward-turning sections (1871, 1872) which is continued to the first rectilinear section (1830) and turns relatively upward and downward-turning sections (1873, 1874) which is continued to the fourth rectilinear section (1860) after being continued to the upward-turning sections (1871, 1872) and turning relatively downward.

5. The clip (1800) according to claim 2, wherein the connection section (1870) includes an annular section consisting of upward-turning sections (1871, 1872) which is continued to the first rectilinear section (1830) and turns relatively upward and downward-turning sections (1873, 1874) which is continued to the fourth rectilinear section (1860) after being continued to the upward-turning sections (1871, 1872) and turning relatively downward.

* * * * *